US012807369B2

(12) United States Patent
Dowd et al.

(10) Patent No.: US 12,807,369 B2
(45) Date of Patent: Nov. 24, 2026

(54) STORAGE BIN FOR A FLAT DECK PALLET

(71) Applicant: TECHNOLOGY CONTAINER CORP., Desoto, TX (US)

(72) Inventors: Fred Dowd, Princeton, MA (US); Roger L. Cleveland, Jr., Arlington, TX (US); Thomas O. Dowd, Boston, MA (US)

(73) Assignee: TECHNOLOGY CONTAINER CORP., Desoto, TX (US)

( * ) Notice: Subject to any disclaimer, the term of this patent is extended or adjusted under 35 U.S.C. 154(b) by 0 days.

(21) Appl. No.: 19/077,170

(22) Filed: Mar. 12, 2025

(65) Prior Publication Data

US 2025/0289620 A1 Sep. 18, 2025

Related U.S. Application Data

(60) Provisional application No. 63/564,012, filed on Mar. 12, 2024.

(51) Int. Cl.
*B65D 21/02* (2006.01)
*B65D 6/16* (2006.01)
(Continued)

(52) U.S. Cl.
CPC ..... *B65D 21/0224* (2013.01); *B65D 11/18* (2013.01); *B65D 19/0018* (2013.01);
(Continued)

(58) Field of Classification Search
CPC ..... B65D 1/00; B65D 1/02; B65D 1/0207; B65D 1/0215; B65D 1/0223; B65D 1/023;
(Continued)

(56) References Cited

U.S. PATENT DOCUMENTS 11,312,534 B2 * 4/2022 Berman ..... B65D 19/06
2007/0251857 A1 * 11/2007 Watanabe ..... B65D 19/02 206/600
(Continued)

FOREIGN PATENT DOCUMENTS

DE 202017104172 U1 * 8/2017 ..... B65D 21/083
GB 2317878 A * 4/1998 ..... B65D 19/06
GB 2333284 A * 7/1999 ..... B65D 11/1873

*Primary Examiner* — Anthony D Stashick
*Assistant Examiner* — Marcos Javier Rodriguez Molina
(74) *Attorney, Agent, or Firm* — KRIEGSMAN & KRIEGSMAN

(57) ABSTRACT

An enclosable storage bin for a flat deck pallet includes a frame-like anchor deck mounted onto the top surface of the pallet about its periphery. The open bottom end of a four-sided lower bin sleeve is fittingly inserted into a U-shaped cavity formed in the anchor deck to create a partially enclosed interior cavity that is dimensioned to retain a smaller-sized payload. If a larger-sized payload requires transport, a union collar is utilized to stack an upper bin sleeve onto the lower bin sleeve in alignment therewith. A plurality of latch-type locking mechanisms formed on the anchor deck and the union collar can be pivotally closed to penetrate through corresponding slots in the upper and lower bin sleeves to retain the components together. An optional end cap can be mounted onto the open top end of either bin sleeve to fully enclose the interior cavity.

12 Claims, 20 Drawing Sheets

(51) Int. Cl.

| | |
|---|---|
| ***B65D 19/00*** | (2006.01) |
| ***B65D 19/38*** | (2006.01) |
| *B65D 19/06* | (2006.01) |
| *B65D 19/18* | (2006.01) |

(52) U.S. Cl.
CPC ..... *B65D 19/38* (2013.01); *B65D 2255/00* (2013.01); *B65D 2519/00034* (2013.01); *B65D 2519/00069* (2013.01); *B65D 2519/00268* (2013.01); *B65D 2519/00338* (2013.01)

(58) Field of Classification Search
CPC .. B65D 1/0246; B65D 1/0261; B65D 1/0276; B65D 1/0284; B65D 1/0292; B65D 1/10; B65D 1/12; B65D 1/14; B65D 1/16; B65D 1/165; B65D 1/18; B65D 1/20; B65D 1/22; B65D 1/225; B65D 1/24; B65D 1/243; B65D 1/246; B65D 1/26; B65D 1/265; B65D 1/30; B65D 1/32; B65D 1/34; B65D 1/36; B65D 1/38; B65D 1/42; B65D 1/44; B65D 1/46; B65D 1/48; B65D 11/00; B65D 11/02; B65D 11/04; B65D 11/06; B65D 11/08; B65D 11/10; B65D 11/105; B65D 11/14; B65D 11/16; B65D 11/18; B65D 11/1806; B65D 11/1813; B65D 11/1826; B65D 11/1833; B65D 11/184; B65D 11/1846; B65D 11/1853; B65D 11/186; B65D 11/1866; B65D 11/1873; B65D 11/188; B65D 11/1886; B65D 11/1893; B65D 11/20; B65D 11/22; B65D 11/24; B65D 11/26; B65D 13/00; B65D 13/04; B65D 15/00; B65D 15/02; B65D 15/06; B65D 15/20; B65D 15/22; B65D 15/24; B65D 17/28; B65D 17/30; B65D 17/401; B65D 17/4011; B65D 17/4012; B65D 17/4014; B65D 19/00; B65D 19/0002; B65D 19/0004; B65D 19/0006; B65D 19/0008; B65D 19/001; B65D 19/0012; B65D 19/0014; B65D 19/0016; B65D 19/0018; B65D 19/0022; B65D 19/0024; B65D 19/0026; B65D 19/0028; B65D 19/003; B65D 19/0032; B65D 19/0034; B65D 19/0036; B65D 19/0038; B65D 19/004; B65D 19/0044; B65D 19/0046; B65D 19/0048; B65D 19/0051; B65D 19/0053; B65D 19/0055; B65D 19/0059; B65D 19/0063; B65D 19/0065; B65D 19/0067; B65D 19/0069; B65D 19/0071; B65D 19/0073; B65D 19/0075; B65D 19/0077; B65D 19/0081; B65D 19/0085; B65D 19/0089; B65D 19/0091; B65D 19/0093; B65D 19/0095; B65D 19/0097; B65D 19/02; B65D 19/04; B65D 19/06; B65D 19/08; B65D 19/10; B65D 19/12; B65D 19/14; B65D 19/16; B65D 19/18; B65D 19/20; B65D 19/36; B65D 19/38; B65D 19/385; B65D 19/40; B65D 19/42; B65D 19/44; B65D 21/00; B65D 21/02; B65D 21/0201; B65D 21/0202; B65D 21/0204; B65D 21/0205; B65D 21/0206; B65D 21/0208; B65D 21/0209; B65D 21/0211; B65D 21/0212; B65D 21/0213; B65D 21/0215; B65D 21/0216; B65D 21/0217; B65D 21/0219; B65D 21/022; B65D 21/0222; B65D 21/0223; B65D 21/0224; B65D 21/0226; B65D 21/0227; B65D 21/0228; B65D 21/023; B65D 21/0231; B65D 21/0233; B65D 21/0234; B65D 21/0235; B65D 21/0237; B65D 21/04; B65D 21/043; B65D 21/045; B65D 21/046; B65D 21/048; B65D 21/06; B65D 21/062; B65D 21/064; B65D 21/066; B65D 21/068; B65D 21/08; B65D 21/083; B65D 21/086; B65D 2201/00; B65D 2203/00; B65D 2203/02; B65D 2203/04; B65D 2203/06; B65D 2203/10; B65D 2203/12; B65D 2205/00; B65D 2205/02; B65D 2207/00; B65D 2209/00; B65D 2211/00; B65D 2213/00; B65D 2213/02; B65D 2215/02; B65D 2215/04; B65D 2215/06; B65D 2231/005; B65D 2231/007; B65D 2231/008; B65D 2231/02; B65D 2231/027; B65D 2251/0015; B65D 2251/0018; B65D 2251/0031; B65D 2251/005; B65D 2251/0071; B65D 2251/0081; B65D 2251/0087; B65D 2251/0093; B65D 2251/04; B65D 2251/1008; B65D 2251/1016; B65D 2251/105; B65D 2251/1058; B65D 2251/1066; B65D 2255/00; B65D 2255/20; B65D 23/00; B65D 23/003; B65D 23/02; B65D 23/0871; B65D 23/0878; B65D 23/0885; B65D 23/10; B65D 23/102; B65D 23/104; B65D 23/12; B65D 23/14; B65D 2301/10; B65D 2301/20; B65D 2303/00; B65D 2313/00; B65D 2313/02; B65D 2313/04; B65D 2313/08; B65D 2313/10; B65D 2401/00; B65D 2401/10; B65D 2401/15; B65D 2401/25; B65D 2401/50; B65D 2401/60; B65D 25/00; B65D 25/005; B65D 25/02; B65D 25/04; B65D 25/06; B65D 25/08; B65D 25/10; B65D 25/101; B65D 25/102; B65D 25/103; B65D 25/106; B65D 25/107; B65D 25/108; B65D 25/14; B65D 25/16; B65D 25/20; B65D 25/205; B65D 25/22; B65D 25/24; B65D 25/28; B65D 25/2808; B65D 25/282; B65D 25/2823; B65D 25/2826; B65D 25/2841; B65D 25/285; B65D 25/2852; B65D 25/2855; B65D 25/2867; B65D 25/2873; B65D 25/2882; B65D 25/2885; B65D 25/2888; B65D 25/2894; B65D 25/2897; B65D 25/30; B65D 25/32; B65D 25/34; B65D 25/36; B65D 25/38; B65D 25/40; B65D 25/42; B65D 25/44; B65D 25/48; B65D 25/525; B65D 25/54; B65D 25/56; B65D 2501/00; B65D 2501/0018; B65D 2501/0027; B65D 2501/0036; B65D 2501/0081; B65D 2501/24019; B65D 2501/2407; B65D 2501/24076; B65D 2501/24082; B65D 2501/24095; B65D 2501/24101; B65D 2501/24108; B65D 2501/24114; B65D 2501/24127; B65D 2501/24133; B65D 2501/2414; B65D 2501/24152; B65D 2501/24184; B65D 2501/24191; B65D 2501/2421; B65D 2501/24216; B65D 2501/24222; B65D 2501/24229;

B65D 2501/24235; B65D 2501/24242; B65D 2501/24248; B65D 2501/24254; B65D 2501/24261; B65D 2501/24267; B65D 2501/24273; B65D 2501/24286; B65D 2501/24292; B65D 2501/24299; B65D 2501/24305; B65D 2501/24318; B65D 2501/24324; B65D 2501/24337; B65D 2501/2435; B65D 2501/24356; B65D 2501/24382; B65D 2501/24401; B65D 2501/24407; B65D 2501/24509; B65D 2501/24515; B65D 2501/24522; B65D 2501/24528; B65D 2501/24535; B65D 2501/24541; B65D 2501/24547; B65D 2501/24566; B65D 2501/24573; B65D 2501/24585; B65D 2501/24592; B65D 2501/24598; B65D 2501/24605; B65D 2501/24656; B65D 2501/24681; B65D 2501/24687; B65D 2501/24694; B65D 2501/24719; B65D 2501/24777; B65D 2501/24783; B65D 2501/24796; B65D 2501/24802; B65D 2501/24808; B65D 2501/24834; B65D 2501/2484; B65D 2501/24847; B65D 2501/24853; B65D 2501/24859; B65D 2501/24878; B65D 2501/24929; B65D 2501/24961; B65D 2517/0013; B65D 2517/0041; B65D 2517/0098; B65D 2517/5091; B65D 2517/5097; B65D 2519/00009; B65D 2519/00019; B65D 2519/00024; B65D 2519/00029; B65D 2519/00034; B65D 2519/00039; B65D 2519/00044; B65D 2519/00054; B65D 2519/00059; B65D 2519/00064; B65D 2519/00069; B65D 2519/00074; B65D 2519/00079; B65D 2519/00089; B65D 2519/00094; B65D 2519/00099; B65D 2519/00104; B65D 2519/00109; B65D 2519/00114; B65D 2519/00124; B65D 2519/00129; B65D 2519/00134; B65D 2519/00139; B65D 2519/00144; B65D 2519/00149; B65D 2519/00159; B65D 2519/00164; B65D 2519/00169; B65D 2519/00174; B65D 2519/00179; B65D 2519/00184; B65D 2519/00199; B65D 2519/00203; B65D 2519/00208; B65D 2519/00213; B65D 2519/00218; B65D 2519/00228; B65D 2519/00233; B65D 2519/00238; B65D 2519/00243; B65D 2519/00253; B65D 2519/00268; B65D 2519/00273; B65D 2519/00278; B65D 2519/00283; B65D 2519/00288; B65D 2519/00293; B65D 2519/00298; B65D 2519/00303; B65D 2519/00308; B65D 2519/00318; B65D 2519/00323; B65D 2519/00328; B65D 2519/00333; B65D 2519/00338; B65D 2519/00343; B65D 2519/00348; B65D 2519/00353; B65D 2519/00358; B65D 2519/00363; B65D 2519/00368; B65D 2519/00373; B65D 2519/00378; B65D 2519/00383; B65D 2519/00388; B65D 2519/00398; B65D 2519/00402; B65D 2519/00407; B65D 2519/00412; B65D 2519/00417; B65D 2519/00422; B65D 2519/00427; B65D 2519/00432; B65D 2519/00437; B65D 2519/00442; B65D 2519/00447; B65D 2519/00452; B65D 2519/00457; B65D 2519/00462; B65D 2519/00467; B65D 2519/00472; B65D 2519/00477; B65D 2519/00482; B65D 2519/00487; B65D 2519/00492; B65D 2519/00497; B65D 2519/00502; B65D 2519/00507; B65D 2519/00512; B65D 2519/00517; B65D 2519/00522; B65D 2519/00527; B65D 2519/00532; B65D 2519/00537; B65D 2519/00542; B65D 2519/00547; B65D 2519/00552; B65D 2519/00557; B65D 2519/00562; B65D 2519/00567; B65D 2519/00587; B65D 2519/00592; B65D 2519/00597; B65D 2519/00601; B65D 2519/00606; B65D 2519/00611; B65D 2519/00616; B65D 2519/00621; B65D 2519/00626; B65D 2519/00631; B65D 2519/00636; B65D 2519/00641; B65D 2519/00646; B65D 2519/00651; B65D 2519/00656; B65D 2519/00661; B65D 2519/00666; B65D 2519/00671; B65D 2519/00676; B65D 2519/00681; B65D 2519/00691; B65D 2519/00696; B65D 2519/00701; B65D 2519/00706; B65D 2519/00711; B65D 2519/00716; B65D 2519/00721; B65D 2519/00726; B65D 2519/00731; B65D 2519/00736; B65D 2519/00741; B65D 2519/00746; B65D 2519/00756; B65D 2519/00761; B65D 2519/00766; B65D 2519/00771; B65D 2519/00776; B65D 2519/00781; B65D 2519/00786; B65D 2519/00791; B65D 2519/00796; B65D 2519/008; B65D 2519/00805; B65D 2519/0081; B65D 2519/00815; B65D 2519/0082; B65D 2519/00825; B65D 2519/0083; B65D 2519/00835; B65D 2519/0084; B65D 2519/0085; B65D 2519/00855; B65D 2519/0086; B65D 2519/00865; B65D 2519/0087; B65D 2519/00875; B65D 2519/0088; B65D 2519/00885; B65D 2519/0089; B65D 2519/00895; B65D 2519/009; B65D 2519/00905; B65D 2519/0091; B65D 2519/00915; B65D 2519/0092; B65D 2519/00925; B65D 2519/0093; B65D 2519/00935; B65D 2519/0094; B65D 2519/00945; B65D 2519/0095; B65D 2519/00955; B65D 2519/0096; B65D 2519/00965; B65D 2519/0097; B65D 2519/00975; B65D 2519/0098; B65D 2519/00985; B65D 2519/0099; B65D 2519/00995; B65D 2525/00; B65D 2525/28; B65D 2525/285; B65D 2525/287; B65D 2525/288; B65D 2543/00009; B65D 2543/00027; B65D 2543/00037; B65D 2543/00046; B65D 2543/00083; B65D 2543/00092; B65D 2543/00101; B65D 2543/0012; B65D 2543/00148; B65D 2543/00166; B65D 2543/00175; B65D 2543/00194; B65D 2543/00203; B65D 2543/00231; B65D 2543/0024; B65D 2543/00268; B65D 2543/00277; B65D 2543/00287; B65D 2543/00296; B65D 2543/00305; B65D

2543/00314; B65D 2543/00324; B65D 2543/00351; B65D 2543/00361; B65D 2543/0037; B65D 2543/00379; B65D 2543/00398; B65D 2543/00407; B65D 2543/00416; B65D 2543/00435; B65D 2543/00444; B65D 2543/00453; B65D 2543/00462; B65D 2543/00472; B65D 2543/0049; B65D 2543/005; B65D 2543/00509; B65D 2543/00518; B65D 2543/00527; B65D 2543/00537; B65D 2543/00546; B65D 2543/00555; B65D 2543/00564; B65D 2543/00574; B65D 2543/00583; B65D 2543/0062; B65D 2543/00629; B65D 2543/00638; B65D 2543/00648; B65D 2543/00657; B65D 2543/00666; B65D 2543/00685; B65D 2543/00694; B65D 2543/00703; B65D 2543/00731; B65D 2543/0074; B65D 2543/00759; B65D 2543/00768; B65D 2543/00796; B65D 2543/00805; B65D 2543/00814; B65D 2543/00824; B65D 2543/00842; B65D 2543/00851; B65D 2543/0087; B65D 2543/00879; B65D 2543/00888; B65D 2543/00925; B65D 2543/00944; B65D 2543/00953; B65D 2543/00972; B65D 2543/0099; B65D 2555/02; B65D 2565/381; B65D 2565/383; B65D 2565/384; B65D 2565/385; B65D 2565/388; B65D 2571/00012; B65D 2571/00018; B65D 2571/00024; B65D 2571/0003; B65D 2571/00037; B65D 2571/00043; B65D 2571/00049; B65D 2571/00055; B65D 2571/00061; B65D 2571/00067; B65D 2571/00074; B65D 2571/00086; B65D 2571/00092; B65D 2571/00098; B65D 2571/00104; B65D 2571/00111; B65D 2571/00117; B65D 2571/00141; B65D 2571/00154; B65D 2571/00209; B65D 2571/0024; B65D 2571/00265; B65D 2571/00271; B65D 2571/00277; B65D 2571/00283; B65D 2571/0029; B65D 2571/00308; B65D 2571/0032; B65D 2571/00327; B65D 2571/00339; B65D 2571/00345; B65D 2571/00358; B65D 2571/00401; B65D 2571/00444; B65D 2571/0045; B65D 2571/00469; B65D 2571/00475; B65D 2571/00487; B65D 2571/00493; B65D 2571/00512; B65D 2571/0053; B65D 2571/00543; B65D 2571/00567; B65D 2571/00574; B65D 2571/00611; B65D 2571/00635; B65D 2571/0066; B65D 2571/00666; B65D 2571/00672; B65D 2571/00679; B65D 2571/00716; B65D 2571/00728; B65D 2571/00746; B65D 2571/00753; B65D 2571/0079; B65D 2571/00796; B65D 2571/00802; B65D 2571/00814; B65D 2571/0082; B65D 2571/00839; B65D 2571/00845; B65D 2571/00858; B65D 2571/00864; B65D 2571/00882; B65D 2571/00895; B65D 2571/00925; B65D 2571/00987; B65D 2575/3245; B65D 2577/042; B65D 2577/043; B65D 2577/047; B65D 2577/048; B65D 2577/2025; B65D 2577/205; B65D 2577/2083; B65D 2581/00; B65D 2581/051; B65D 2581/052; B65D 2581/053; B65D 581/055; B65D 2581/056; B65D 2581/057; B65D 2581/3472; B65D 2581/3479; B65D 2583/00; B65D 2583/0481; B65D 2583/049; B65D 2585/00; B65D 2585/366; B65D 2585/545; B65D 2585/56; B65D 2585/643; B65D 2585/647; B65D 2585/648; B65D 2585/649; B65D 2585/68; B65D 2585/6805; B65D 2585/6815; B65D 2585/6817; B65D 2585/682; B65D 2585/6825; B65D 2585/6837; B65D 2585/6845; B65D 2585/6855; B65D 2585/686; B65D 2585/6862; B65D 2585/6865; B65D 2585/6867; B65D 2585/6872; B65D 2585/6875; B65D 2585/6877; B65D 2585/688; B65D 2585/6882; B65D 2585/6887; B65D 2585/689; B65D 2585/6892; B65D 2585/6897; B65D 2585/86; B65D 2585/88; B65D 2588/12; B65D 2588/125; B65D 2588/162; B65D 2588/165; B65D 2588/167; B65D 2588/54; B65D 2588/74; B65D 2588/743; B65D 2588/746; B65D 2590/0016; B65D 2590/0041; B65D 2590/005; B65D 2590/0058; B65D 2590/0066; B65D 2590/0075; B65D 2590/0083; B65D 2590/0091; B65D 2590/02; B65D 2590/023; B65D 2590/043; B65D 2590/046; B65D 2590/542; B65D 2590/547; B65D 2590/666; B65D 27/00; B65D 29/00; B65D 29/04; B65D 3/04; B65D 3/06; B65D 3/10; B65D 3/12; B65D 3/14; B65D 3/22; B65D 31/00; B65D 31/02; B65D 31/04; B65D 31/06; B65D 31/08; B65D 31/10; B65D 31/12; B65D 31/14; B65D 31/16; B65D 33/00; B65D 33/004; B65D 33/005; B65D 33/008; B65D 33/01; B65D 33/02; B65D 33/06; B65D 33/10; B65D 33/105; B65D 33/14; B65D 33/16; B65D 33/1616; B65D 33/1691; B65D 33/24; B65D 33/25; B65D 33/2508; B65D 35/08; B65D 37/00; B65D 39/00; B65D 39/0023; B65D 39/025; B65D 39/08; B65D 39/082; B65D 41/005; B65D 41/04; B65D 41/0442; B65D 41/0471; B65D 41/08; B65D 41/165; B65D 41/34; B65D 41/48; B65D 41/58; B65D 43/00; B65D 43/02; B65D 43/0202; B65D 43/0204; B65D 43/0206; B65D 43/0208; B65D 43/021; B65D 43/0212; B65D 43/0218; B65D 43/022; B65D 43/0222; B65D 43/0225; B65D 43/0231; B65D 43/0237; B65D 43/0239; B65D 43/0245; B65D 43/0249; B65D 43/0254; B65D 43/0256; B65D 43/0258; B65D 43/06; B65D 43/12; B65D 43/14; B65D 43/16; B65D 43/161; B65D 43/162; B65D 45/00; B65D 45/02; B65D 45/025; B65D 45/16; B65D 45/18; B65D 45/20; B65D 45/22; B65D 45/24;

B65D 45/28; B65D 45/30; B65D 45/32; B65D 45/345; B65D 47/06; B65D 47/061; B65D 47/063; B65D 47/0838; B65D 47/0842; B65D 47/0885; B65D 47/10; B65D 47/121; B65D 47/122; B65D 47/123; B65D 47/185; B65D 47/2087; B65D 47/247; B65D 47/249; B65D 47/265; B65D 47/286; B65D 49/02; B65D 5/00; B65D 5/0005; B65D 5/001; B65D 5/0015; B65D 5/002; B65D 5/0025; B65D 5/003; B65D 5/0035; B65D 5/0045; B65D 5/005; B65D 5/0055; B65D 5/006; B65D 5/0065; B65D 5/0075; B65D 5/009; B65D 5/02; B65D 5/0218; B65D 5/0236; B65D 5/0254; B65D 5/0281; B65D 5/029; B65D 5/04; B65D 5/06; B65D 5/061; B65D 5/064; B65D 5/065; B65D 5/10; B65D 5/103; B65D 5/106; B65D 5/12; B65D 5/14; B65D 5/16; B65D 5/18; B65D 5/20; B65D 5/2004; B65D 5/2009; B65D 5/2033; B65D 5/2038; B65D 5/2047; B65D 5/2052; B65D 5/2057; B65D 5/2076; B65D 5/22; B65D 5/24; B65D 5/248; B65D 5/28; B65D 5/30; B65D 5/308; B65D 5/32; B65D 5/321; B65D 5/322; B65D 5/323; B65D 5/324; B65D 5/326; B65D 5/328; B65D 5/36; B65D 5/3607; B65D 5/3614; B65D 5/3621; B65D 5/3628; B65D 5/3635; B65D 5/3642; B65D 5/3671; B65D 5/3678; B65D 5/3685; B65D 5/38; B65D 5/40; B65D 5/42; B65D 5/4204; B65D 5/4208; B65D 5/4212; B65D 5/4216; B65D 5/4233; B65D 5/4245; B65D 5/425; B65D 5/4266; B65D 5/427; B65D 5/4279; B65D 5/4283; B65D 5/4295; B65D 5/44; B65D 5/441; B65D 5/443; B65D 5/445; B65D 5/446; B65D 5/46; B65D 5/46008; B65D 5/46024; B65D 5/46032; B65D 5/46072; B65D 5/4608; B65D 5/46096; B65D 5/4612; B65D 5/48; B65D 5/48002; B65D 5/48014; B65D 5/48022; B65D 5/48024; B65D 5/48026; B65D 5/48038; B65D 5/4804; B65D 5/48042; B65D 5/48046; B65D 5/48048; B65D 5/50; B65D 5/5002; B65D 5/5004; B65D 5/5021; B65D 5/5023; B65D 5/5028; B65D 5/503; B65D 5/5033; B65D 5/5035; B65D 5/5038; B65D 5/504; B65D 5/5045; B65D 5/5047; B65D 5/505; B65D 5/5054; B65D 5/5059; B65D 5/5069; B65D 5/5088; B65D 5/509; B65D 5/52; B65D 5/5206; B65D 5/5213; B65D 5/5253; B65D 5/526; B65D 5/54; B65D 5/5405; B65D 5/541; B65D 5/542; B65D 5/5425; B65D 5/5445; B65D 5/545; B65D 5/548; B65D 5/5495; B65D 5/56; B65D 5/563; B65D 5/566; B65D 5/58; B65D 5/60; B65D 5/603; B65D 5/606; B65D 5/62; B65D 5/64; B65D 5/643; B65D 5/66; B65D 5/6626; B65D 5/6632; B65D 5/6638; B65D 5/6644; B65D 5/665; B65D 5/6652; B65D 5/6655; B65D 5/6658; B65D 5/6664; B65D 5/6667; B65D 5/6673; B65D 5/6697; B65D 5/68; B65D 5/685; B65D 5/703; B65D 5/72; B65D 5/721; B65D 5/722; B65D 5/725; B65D 5/726; B65D 5/727; B65D 5/746; B65D 5/747; B65D 50/00; B65D 50/04; B65D 50/046; B65D 51/00; B65D 51/007; B65D 51/1611; B65D 51/1644; B65D 51/165; B65D 51/1683; B65D 51/18; B65D 51/185; B65D 51/20; B65D 51/222; B65D 51/226; B65D 51/24; B65D 51/242; B65D 51/245; B65D 51/246; B65D 51/247; B65D 51/248; B65D 51/249; B65D 51/26; B65D 51/28; B65D 51/30; B65D 53/00; B65D 53/02; B65D 55/02; B65D 55/024; B65D 55/028; B65D 55/06; B65D 55/0863; B65D 55/10; B65D 55/12; B65D 55/14; B65D 57/00; B65D 57/002; B65D 57/003; B65D 57/004; B65D 57/005; B65D 57/006; B65D 59/00; B65D 59/08; B65D 61/00; B65D 63/00; B65D 63/10; B65D 63/1009; B65D 63/1027; B65D 63/1045; B65D 63/1054; B65D 63/1063; B65D 63/1072; B65D 63/1081; B65D 63/109; B65D 63/16; B65D 65/00; B65D 65/02; B65D 65/10; B65D 65/14; B65D 65/18; B65D 65/22; B65D 65/38; B65D 65/40; B65D 65/403; B65D 65/406; B65D 65/42; B65D 65/44; B65D 65/46; B65D 65/466; B65D 67/02; B65D 69/00; B65D 7/00; B65D 7/02; B65D 7/04; B65D 7/045; B65D 7/06; B65D 7/08; B65D 7/14; B65D 7/20; B65D 7/22; B65D 7/24; B65D 7/26; B65D 7/28; B65D 7/30; B65D 7/32; B65D 7/36; B65D 7/38; B65D 7/40; B65D 7/42; B65D 7/44; B65D 7/48; B65D 71/00; B65D 71/0003; B65D 71/0007; B65D 71/0011; B65D 71/0022; B65D 71/0055; B65D 71/0059; B65D 71/0077; B65D 71/0085; B65D 71/0088; B65D 71/0092; B65D 71/0096; B65D 71/02; B65D 71/04; B65D 71/06; B65D 71/063; B65D 71/066; B65D 71/08; B65D 71/10; B65D 71/125; B65D 71/14; B65D 71/16; B65D 71/36; B65D 71/38; B65D 1/40; B65D 71/42; B65D 71/44; B65D 71/50; B65D 71/502; B65D 71/504; B65D 71/70; B65D 71/72; B65D 73/0042; B65D 73/0057; B65D 73/0092; B65D 73/02; B65D 75/00; B65D 75/002; B65D 75/004; B65D 75/006; B65D 75/008; B65D 75/04; B65D 75/08; B65D 75/12; B65D 75/20; B65D 75/28; B65D 75/30; B65D 75/327; B65D 75/36; B65D 75/366; B65D 75/367; B65D 75/38; B65D 75/52; B65D 75/525; B65D 75/527; B65D 75/54; B65D 75/56; B65D 75/566; B65D 75/58; B65D 75/5805; B65D 75/5827; B65D 75/5833; B65D 75/5838; B65D 75/585; B65D 75/5866; B65D 75/5877; B65D 75/5883; B65D 75/5888; B65D 75/5894; B65D 77/00; B65D 77/003; B65D 77/02; B65D 77/04;

B65D 77/0413; B65D 77/042; B65D 77/0426; B65D 77/0433; B65D 77/0446; B65D 77/0453; B65D 77/046; B65D 77/0466; B65D 77/0486; B65D 77/06; B65D 77/061; B65D 77/062; B65D 77/064; B65D 77/065; B65D 77/067; B65D 77/068; B65D 77/10; B65D 77/20; B65D 77/2024; B65D 77/2032; B65D 77/22; B65D 77/225; B65D 77/24; B65D 77/245; B65D 77/26; B65D 77/30; B65D 79/00; B65D 79/005; B65D 79/0081; B65D 79/0084; B65D 79/0087; B65D 79/02; B65D 81/00; B65D 81/02; B65D 81/022; B65D 81/025; B65D 81/027; B65D 81/03; B65D 81/05; B65D 81/051; B65D 81/052; B65D 81/053; B65D 81/054; B65D 81/055; B65D 81/056; B65D 81/057; B65D 81/058; B65D 81/07; B65D 81/09; B65D 81/107; B65D 81/1075; B65D 81/113; B65D 81/127; B65D 81/1275; B65D 81/133; B65D 81/18; B65D 81/20; B65D 81/2007; B65D 81/2015; B65D 81/2023; B65D 81/203; B65D 81/2069; B65D 81/2076; B65D 81/2084; B65D 81/24; B65D 81/245; B65D 81/26; B65D 81/261; B65D 81/263; B65D 81/264; B65D 81/265; B65D 81/266; B65D 81/267; B65D 81/268; B65D 81/28; B65D 81/30; B65D 81/3205; B65D 81/3211; B65D 81/3216; B65D 81/3233; B65D 81/3266; B65D 81/3294; B65D 81/343; B65D 81/3446; B65D 81/3453; B65D 81/3461; B65D 81/36; B65D 81/361; B65D 81/365; B65D 81/368; B65D 81/38; B65D 81/3806; B65D 81/3813; B65D 81/3816; B65D 81/3818; B65D 81/382; B65D 81/3823; B65D 81/3825; B65D 81/3827; B65D 81/383; B65D 81/3834; B65D 81/3841; B65D 81/3858; B65D 81/3862; B65D 81/3874; B65D 81/389; B65D 81/3893; B65D 81/3895; B65D 81/3897; B65D 83/00; B65D 83/0409; B65D 83/0427; B65D 83/0463; B65D 83/0481; B65D 83/06; B65D 83/08; B65D 83/0805; B65D 83/0847; B65D 83/0894; B65D 83/38; B65D 83/40; B65D 83/425; B65D 83/46; B65D 83/62; B65D 83/76; B65D 83/766; B65D 83/768; B65D 83/771; B65D 83/7713; B65D 85/00; B65D 85/02; B65D 85/04; B65D 85/06; B65D 85/07; B65D 85/08; B65D 85/10; B65D 85/1018; B65D 85/1045; B65D 85/185; B65D 85/20; B65D 85/24; B65D 85/26; B65D 85/30; B65D 85/302; B65D 85/305; B65D 85/307; B65D 85/32; B65D 85/321; B65D 85/324; B65D 85/34; B65D 85/345; B65D 85/36; B65D 85/38; B65D 85/42; B65D 85/44; B65D 85/46; B65D 85/48; B65D 85/50; B65D 85/505; B65D 85/52; B65D 85/54; B65D 85/542; B65D 85/544; B65D 85/60; B65D 85/62; B65D 85/64; B65D 85/66; B65D 85/67; B65D 85/671; B65D 85/672; B65D 85/676; B65D 85/68; B65D 85/70; B65D 85/72; B65D 85/76; B65D 85/78; B65D 85/80; B65D 85/804; B65D 85/8043; B65D 85/8046; B65D 85/8055; B65D 85/808; B65D 85/8085; B65D 85/812; B65D 85/84; B65D 88/005; B65D 88/02; B65D 88/022; B65D 88/025; B65D 88/027; B65D 88/06; B65D 88/10; B65D 88/12; B65D 88/121; B65D 88/123; B65D 88/125; B65D 88/126; B65D 88/127; B65D 88/128; B65D 88/129; B65D 88/14; B65D 88/16; B65D 88/1606; B65D 88/1612; B65D 88/1618; B65D 88/1625; B65D 88/1631; B65D 88/1637; B65D 88/1643; B65D 88/1656; B65D 88/1668; B65D 88/1675; B65D 88/1681; B65D 88/1687; B65D 88/1693; B65D 88/18; B65D 88/20; B65D 88/22; B65D 88/24; B65D 88/26; B65D 88/28; B65D 88/30; B65D 88/32; B65D 88/52; B65D 88/522; B65D 88/524; B65D 88/526; B65D 88/528; B65D 88/54; B65D 88/542; B65D 88/546; B65D 88/56; B65D 88/58; B65D 88/60; B65D 88/62; B65D 88/66; B65D 88/74; B65D 88/741; B65D 88/742; B65D 88/744; B65D 88/745; B65D 88/748; B65D 88/76; B65D 88/78; B65D 9/00; B65D 9/04; B65D 9/06; B65D 9/12; B65D 9/14; B65D 9/16; B65D 9/18; B65D 9/22; B65D 9/24; B65D 9/30; B65D 9/32; B65D 9/34; B65D 9/38; B65D 90/00; B65D 90/0006; B65D 90/0013; B65D 90/002; B65D 90/0026; B65D 90/0033; B65D 90/004; B65D 90/0046; B65D 90/0053; B65D 90/006; B65D 90/0066; B65D 90/0073; B65D 90/008; B65D 90/0086; B65D 90/02; B65D 90/021; B65D 90/022; B65D 90/023; B65D 90/027; B65D 90/028; B65D 90/041; B65D 90/046; B65D 90/06; B65D 90/08; B65D 90/10; B65D 90/12; B65D 90/14; B65D 90/143; B65D 90/146; B65D 90/16; B65D 90/18; B65D 90/20; B65D 90/205; B65D 90/22; B65D 90/24; B65D 90/34; B65D 90/48; B65D 90/501; B65D 90/52; B65D 90/54; B65D 90/56; B65D 90/58; B65D 90/582; B65D 90/587; B65D 90/623; B65D 90/626; B65D 90/66

USPC .... 206/0.6, 0.7, 1.5, 183, 19, 194, 203, 204, 206/216, 217, 232, 233, 3, 303, 304, 206/307.1, 308.1, 308.3, 315.11, 317, 206/320, 321, 335, 386, 388, 390, 391, 206/394, 395, 397, 400, 407, 408, 409, 206/413, 416, 423, 438, 440, 443, 446, 206/448, 449, 451, 453, 454, 457, 459.5, 206/477, 499, 501, 503, 504, 505, 508, 206/509, 510, 511, 512, 513, 514, 515, 206/517, 519, 521, 523, 524.2, 526, 527, 206/53, 531, 534, 549, 557, 561, 564, 206/565, 566, 581, 583, 585, 586, 589, 206/591, 592, 596, 597, 598, 599, 600, 206/703, 707, 710, 722, 736, 766, 772, 206/774, 804, 816, 576, 594; 220/1.5, 220/1.6, 23.87, 324, 4.09, 4.16, 4.17,

220/4.28, 4.29, 4.32, 4.33, 485, 495,
220/495.05, 495.11, 500, 507, 529, 6,
220/62.11, 625, 659, 676, 755
See application file for complete search history.

(56) References Cited

U.S. PATENT DOCUMENTS

| | | | | |
|---|---|---|---|---|
| 2010/0224625 | A1* | 9/2010 | Uno | B65D 19/18 220/4.33 |
| 2011/0132801 | A1* | 6/2011 | Elder | B65D 19/18 108/51.11 |
| 2020/0108982 | A1* | 4/2020 | Cope | B65D 43/0212 |
| 2020/0399014 | A1* | 12/2020 | Shuert | B65D 19/06 |

* cited by examiner

STORAGE BIN FOR A FLAT DECK PALLET

CROSS-REFERENCE TO RELATED APPLICATIONS

The present invention claims the benefit under 35 U.S.C. 119(e) to U.S. Provisional Patent Application No. 63/564,012, which was filed on Mar. 12, 2024, in the names of Fred Dowd et al., the disclosure of which is incorporated herein by reference.

FIELD OF THE INVENTION

The present invention relates generally to the handling, storage, and shipment of large-load parcels and, more particularly, to pallet-based containers used in the collection and transport of such parcels.

BACKGROUND OF THE INVENTION

Shipping carriers are routinely required to handle, store, and transport large-load parcels, or bundles. To facilitate the collection and shipment of such parcels, pallet-based containers are traditionally utilized.

One type of pallet-based shipment container which is well known in the art includes a flat deck plastic pallet on which is mounted a shipping, or gaylord, box. Traditionally, the shipping box is constructed of a paper-based corrugated material, such as cardboard, and includes four adjacent panels, or sidewalls, which together define an enlarged interior cavity which is suitably dimensioned to retain the desired parcels. The top edge of the panels often remains open to readily allow for the insertion of items therein. However, the bottom edge of each panel is typically provided with an enclosure flap. Accordingly, by inwardly folding the plurality of flaps, the bottom of the shipping box can be selectively enclosed.

Traditionally, a shipment container of the type as described above is utilized in the following manner. First, the flaps on the shipping box are pivoted inward to create an enclosed bottom end. Then, with the pallet preferably disposed on a flat and stable surface, the enclosed bottom end of the shipping box is positioned upon the top surface of the pallet without any direct connection thereto. Thereafter, the desired parcels are disposed into the interior cavity of the shipping box. With all the parcels deposited into the shipping box, the open top end is often enclosed with a cover or a secondary pallet to protect the parcels. Assembled as such, the shipment container can be stored and/or transported as needed. Once the shipment container reaches the intended destination, the shipping box is often torn or otherwise destroyed in order to access the contents retained therein.

As can be appreciated, shipment containers of the type as set forth in detail above have been found to suffer from a few notable shortcomings.

As a first shortcoming, shipment containers of the type as described above rely primarily on the weight of the parcels to retain the shipping box in place on the pallet. However, without any direct means of securing the shipping box to the pallet, the shipping box is prone to slide off the pallet during transport, thereby resulting in the potential spillage of and/or damage to the shipped parcels as well as possible injury to individuals in proximity to the containers.

As a second shortcoming, shipment containers of the type described above are relatively expensive in nature. Notably, the extra material required to form the bottom flaps significantly increases the overall manufacturing cost of the box.

Additionally, as referenced above, the paper-based shipping box is often destroyed upon completion of transport to the intended location. As a result, the shipping box primarily functions as a single-use product.

As a third shortcoming, the paper-based box has been found to be limited in strength and durability. In fact, the box often becomes distended or distorted from the pressure applied from parcels retained therein. As a result, the shipping box is susceptible to damage during transport that may result in parcels spilling out from the container.

SUMMARY OF THE INVENTION

In view thereof, it is an object of the present invention to provide a novel enclosable storage bin for a flat deck pallet.

It is another object of the present invention to provide an enclosable storage bin of the type as described above which can be releasably secured to the flat deck pallet to prevent inadvertent dissociation therefrom.

It is yet another object of the present invention to provide an enclosable storage bin of the type as described above that is inexpensive to manufacture, easy to use, and reusable.

It is still another object of the present invention to provide an enclosable storage bin of the type as described above that is both strong and durable, thereby ensuring optimal protection to any parcels retained therein.

It is yet still another object of the present invention to provide an enclosable storage bin of the type as described above that is variable in size in order to accommodate different volumes of payloads and thereby promote optimal spatial efficiency during transport.

Accordingly, as one feature of the present invention, there is provided a storage bin for a flat deck pallet, the flat deck pallet having a top surface, a bottom surface, and an outer peripheral edge, the storage bin comprising (a) an anchor deck adapted to be mounted onto the top surface of the flat deck pallet about the outer peripheral edge, and (b) a lower bin sleeve mounted onto the anchor deck, the lower bin sleeve having an open top end and an open bottom end, (c) wherein the anchor deck comprises at least one locking mechanism for releasably securing the lower bin sleeve to the anchor deck.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings, wherein like reference numerals represent like parts.

DETAILED DESCRIPTION OF THE INVENTION

Pallet-Based Shipping Container 11

Figure 1:
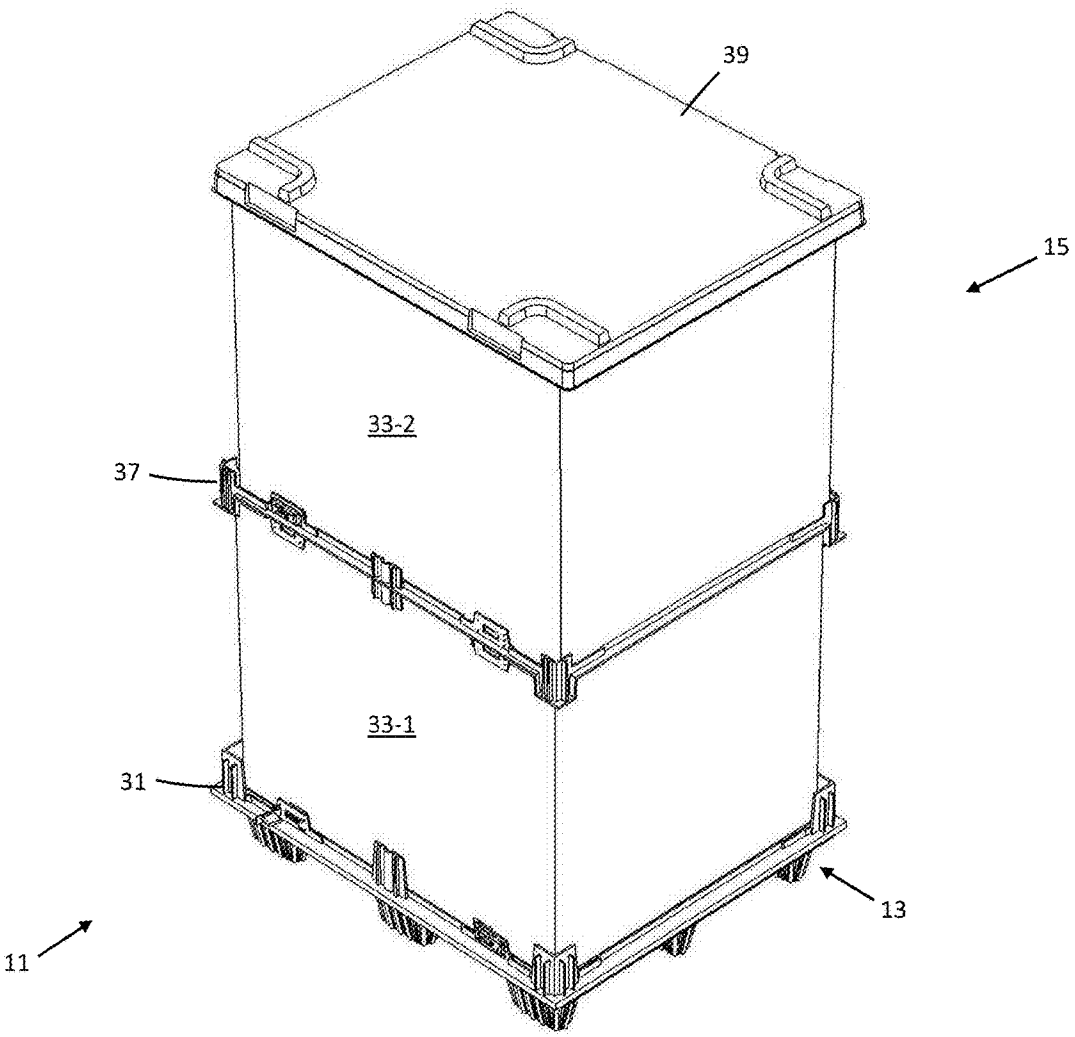
FIG. 1 is a top, front perspective view of a shipping container constructed according to the teachings of the present invention.
Figure 2:
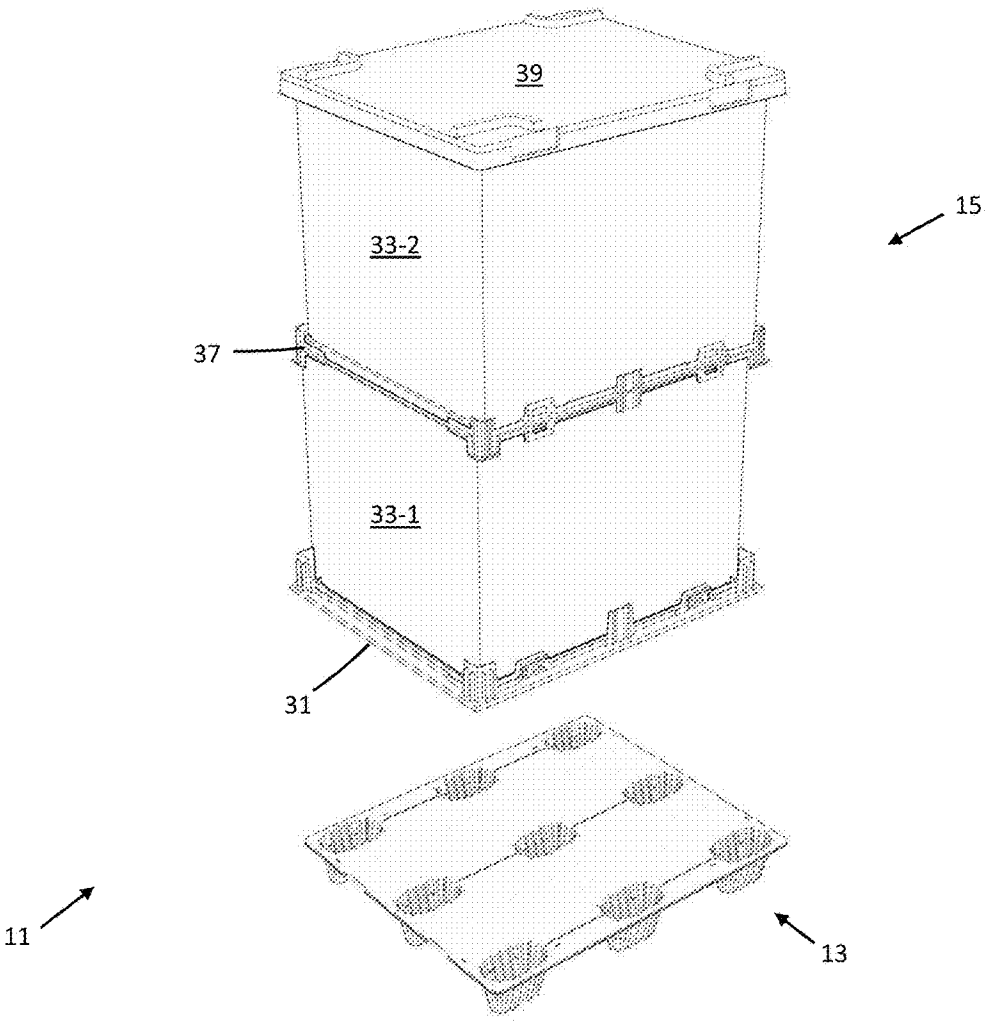
FIG. 2 is a partially exploded, top, rear perspective view of the shipping container shown in FIG. 1.
Figure 3:
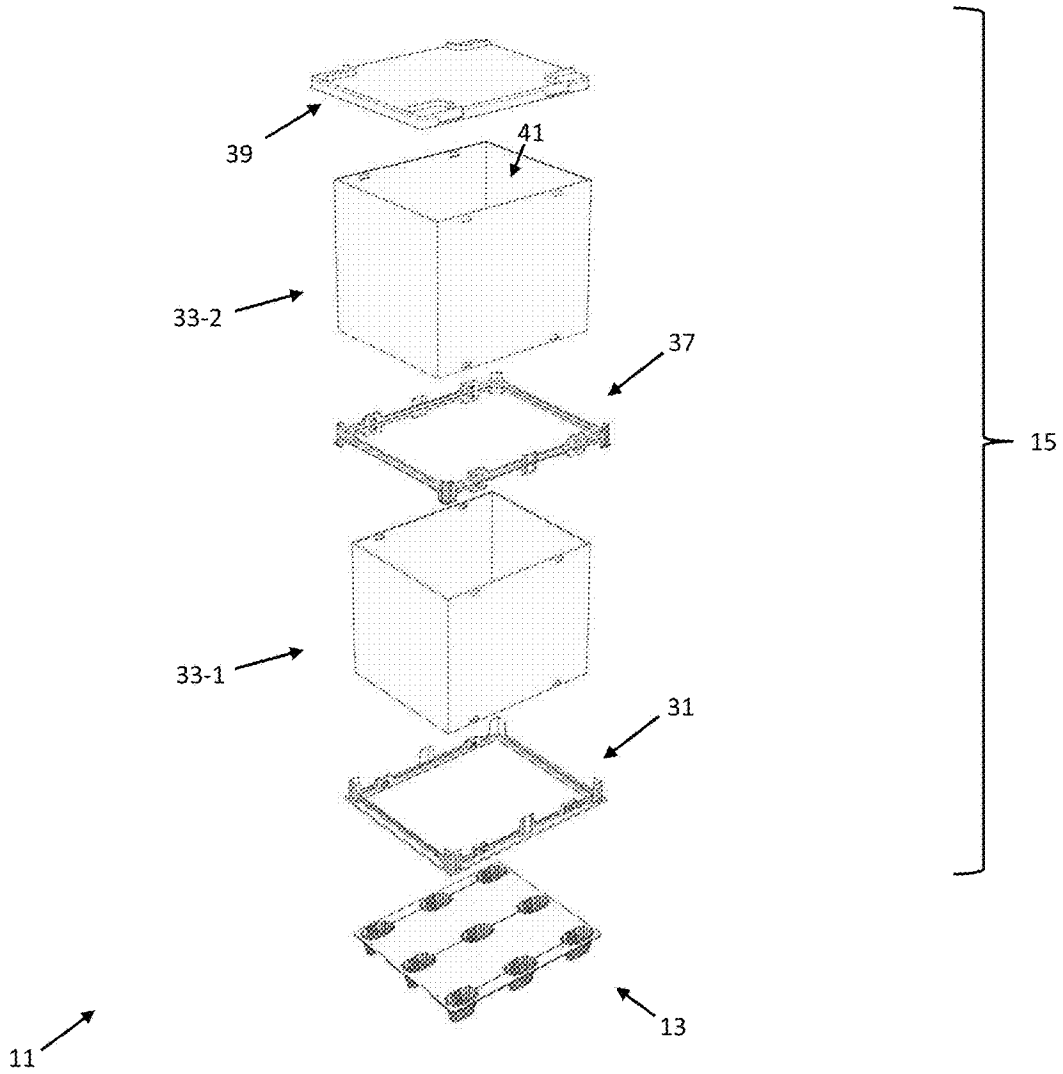
FIG. 3 is a fully exploded, top, rear perspective view of the shipping container shown in FIG. 1.

Referring now to FIGS. 1-3, there are shown fully assembled, partially exploded, and fully exploded top perspective views, respectively, of a pallet-based shipping container constructed according to the teachings of the present invention, the container being identified generally herein by reference numeral 11. As will be explained in detail below, container 11 is principally designed to handle, store, and transport large-load parcels. Due to its unique construction, container 11 is rendered more stable, durable, and inexpensive than traditional pallet-based shipping containers.

In the description that follows, shipping container 11 is described as being particularly well-suited for the collection and transport of paper-type parcels, or mail. However, it is to be understood that container 11 is not limited to the handling and shipment of paper-based parcels. Rather, it is to be understood that container 11 could be used to retain any sizable load in need of transport.

As seen in FIG. 2, shipping container 11 comprises a flat deck pallet 13 on which is secured an enclosable storage bin 15. As will be described further in detail below, the various components of container 11 are constructed of a relatively rigid material and are secured together using a strong retentive force, thereby rendering container 11 highly durable and less susceptible to damage and potential disassembly during use.

Flat deck pallet 13 is a unitary plastic member which serves as the support, or base, for container 11. Pallet 13 is represented herein as being generally of the type which is currently utilized by active shipping services, such as the United States Postal Service (USPS). However, it should be noted that container 11 is not limited to the particular design of flat deck pallet 13. Rather, it is to be understood that the design of storage bin 15 renders it compatible with other similar-sized flat-deck pallets without departing from the spirit of the present invention.

Figure 4:
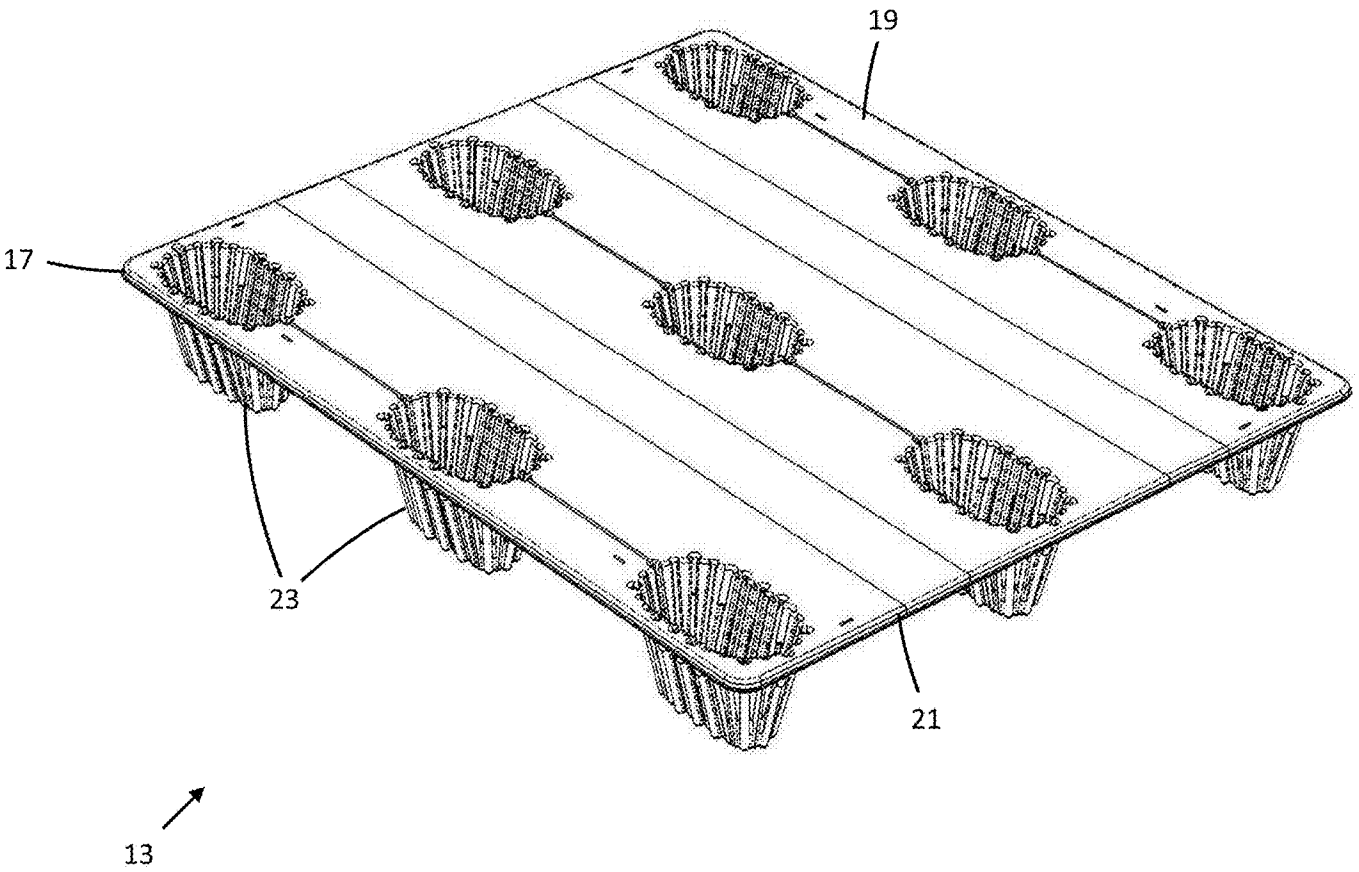
FIG. 4 is a top, front perspective view of the flat deck pallet shown in FIG. 3.

As seen most clearly in FIG. 4, pallet 13 is constructed as a generally planar tray, or plate, 17 with an enlarged, generally planar, top surface 19 and an enlarged, generally planar, bottom surface 21. A plurality of spaced-apart feet 23 is formed in tray 17 and protrude out from bottom surface 21 a fixed height. As such, feet 23 provide pallet 13 with a flat and stable support, or mounting, surface. Additionally, the fixed separation of feet 23 enables a lifting mechanism, such as a forklift, to be drawn in direct contact against bottom surface 21 in order to facilitate transport of container 11.

Storage Bin 15

As noted above, storage bin 15 is uniquely designed to retain a large-load parcel in a secure and durable fashion. Accordingly, the construction of storage bin 15, particularly the means of interconnection between its components as well as with flat deck pallet 13, serves as the primary novel feature of the present invention.

As seen most clearly in FIG. 3, storage bin 15 comprises (i) a pallet anchor, or anchor deck, 31 mounted onto pallet 13, (ii) a lower bin sleeve 33-1 mounted onto pallet anchor 31, (iii) a union, or sleeve, collar 37 mounted onto the distal end of lower bin sleeve 33-1, (iv) an upper bin sleeve 33-2 mounted onto union collar 37, and (v) an end cap 39 mounted onto the distal end of upper bin sleeve 33-2. Together, storage bin 15 and pallet 13 define an enclosed interior cavity 41 that is appropriately dimensioned to receive a sizable parcel load.

Pallet Anchor 31

Figure 5:
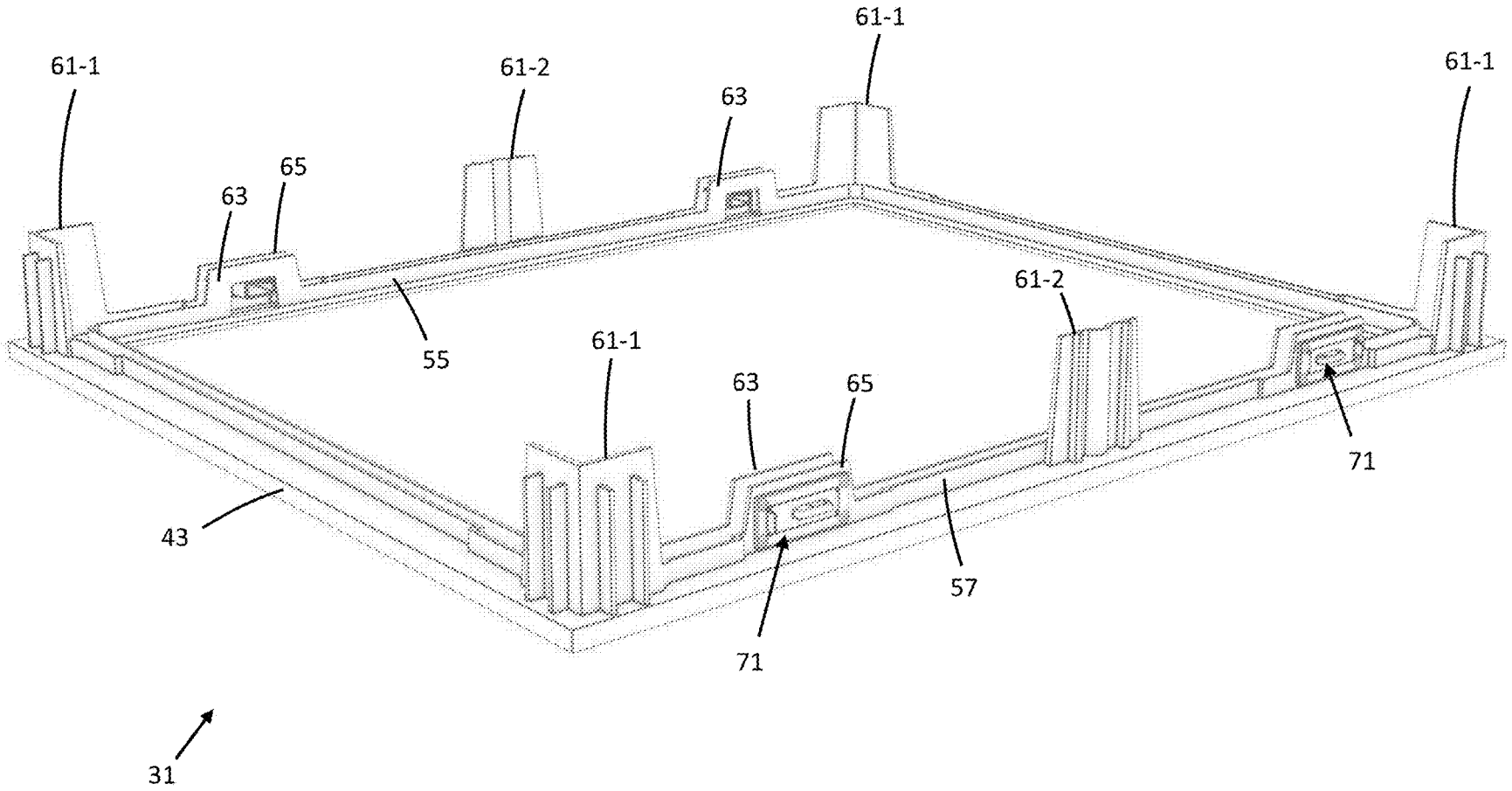
FIG. 5 is a top, rear perspective view of the pallet anchor shown in FIG. 3.
Figure 6:
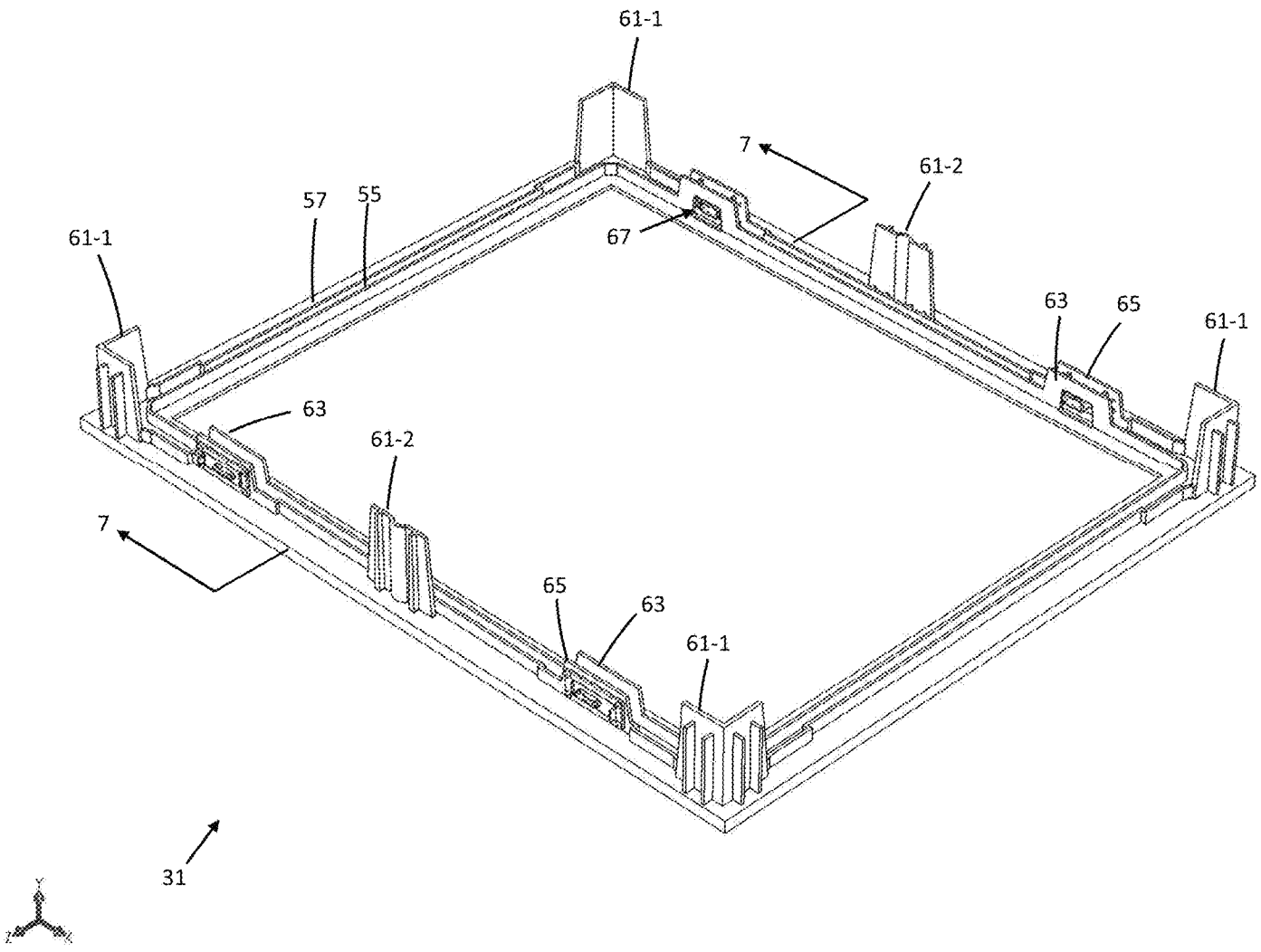
FIG. 6 is a top, front perspective view of the pallet anchor shown in FIG. 3.
Figure 7:
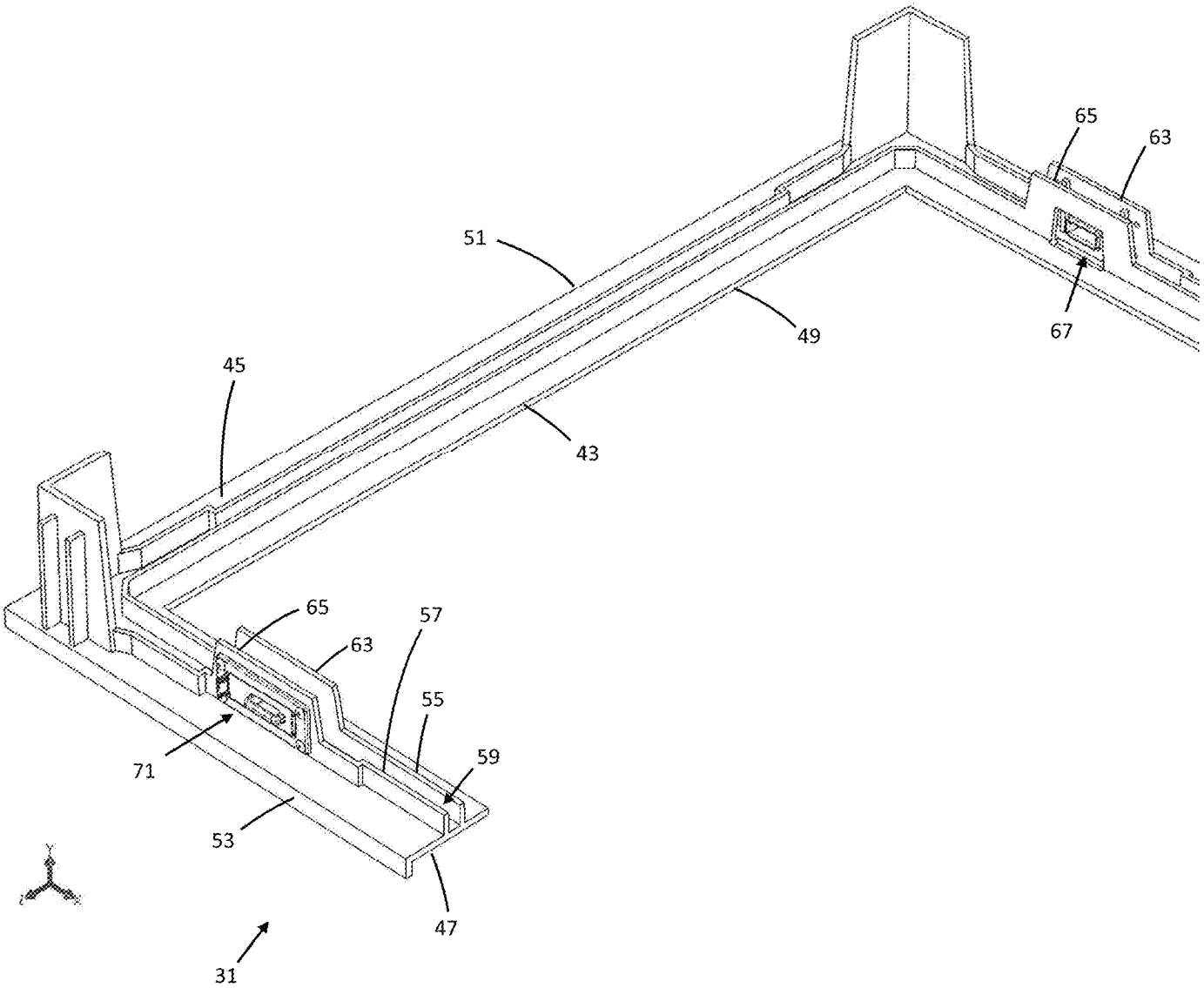
FIG. 7 is a top, front section view of the pallet anchor shown in FIG. 6, taken along lines 7-7.

Referring now to FIGS. 5-7, pallet anchor 31 is preferably constructed out of a rigid and durable material, such as high-density polyethylene (HDPE). As such, pallet anchor 31 is suitably designed to be mass produced through an injection molding process.

As seen most clearly in FIG. 7, pallet anchor 31 comprises a generally rectangular planar frame 43 which includes a flat top surface 45, a flat bottom surface 47, an inner edge 49 and an outer edge 51. A continuous flange, or lip, 53 protrudes orthogonally downward from bottom surface 49 along outer edge 51. As will be explained further below, flange 53 is designed to directly abut against the peripheral edge of pallet tray 17 and thereby maintain proper registration of anchor 31 on pallet 13.

Although not shown herein, it is to be understood that one or more fastening elements may be driven vertically down through frame 43 and into pallet 13 in order to connect, or affix, pallet anchor 31 to pallet 13. Additionally, or in place thereof, pallet anchor 31 may also be equipped with a latch or other similar locking mechanism that is adapted to slide horizontally relative to frame 43 and align directly against bottom surface 21 of pallet 13, thereby securing pallet anchor 31 onto pallet 13.

A continuous inner wall 55 protrudes orthogonally upward from top surface 45 close to inner edge 49. Additionally, a continuous outer wall 57 protrudes orthogonally upward from top surface 45 a fixed distance spaced apart from inner wall 55. Together, top surface 45, inner wall 55, and outer wall 57 form a U-shaped cavity 59 which is dimensioned to fittingly receive the bottom edge of lower bin sleeve 33-1 upon assembly.

As seen most clearly in FIGS. 5 and 6, a first set of raised projections 61-1 is integrally formed onto outer wall 57 at each corner. A second set of raised projections 61-2 is integrally formed onto outer wall 57 at the approximate midpoint of opposing side portions. Projections 61 extend substantially upward from outer wall 57 and are designed to abut firmly against the outer surface of lower bin sleeve 33-1 upon assembly of container 11. In this manner, projections 61 provide support to lower bin sleeve 33-1 as parcels are deposited into interior cavity 41 and thereby limit any distending, or bulging, of sleeve 33-1.

A first set of inner tabs 63 is integrally formed onto and projects upwardly away from the distal end of inner wall 55 at various locations along its length. Additionally, a second set of outer tabs 65 is integrally formed onto and projects upwardly away from the distal end of outer wall 57 at various locations along its length. As can be seen, each outer tab 65 is disposed in direct alignment with a corresponding inner tab 63 so as to form a complementary pair.

Each of tabs 63 and 65 is shaped to define a rectangular window 67. As will be described further in detail below, windows 67 in complementary tabs 63 and 65 are designed to fittingly receive the latch from a locking mechanism in order to fixedly connect lower bin sleeve 33-1 to anchor deck 31.

Figure 8:
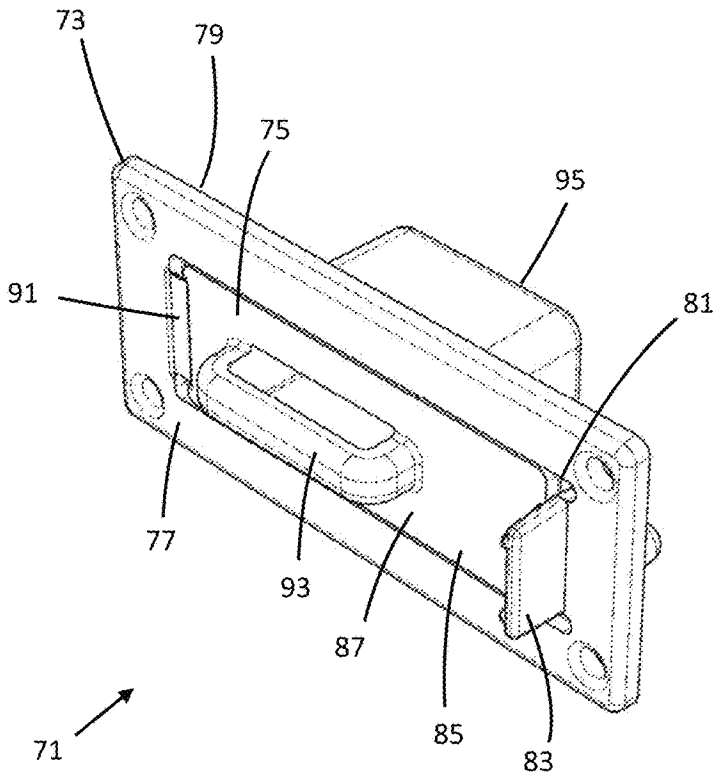
FIG. 8 is a top, front perspective view of one of the locking mechanisms shown in FIG. 6.

Specifically, as shown most clearly in FIGS. 7 and 8, pallet anchor 31 includes a locking mechanism 71 mounted on the outer surface of each outer tab 65. In the present embodiment, locking mechanism 71 is shown as being constructed separately from outer tab 65 and subsequently connected thereto. However, it is to be understood that pallet anchor 31 could be alternatively constructed with locking mechanism 71 integrally formed onto outer tab 65 without departing from the spirit of the present invention.

As can be seen, each locking mechanism 71 comprises a bracket, or buckle, 73 onto which a latch, or lock, 75 is pivotally coupled. As will be explained further below, latch 75 is designed to be selectively inserted through windows 67 of an associated pair of tabs 63 and 65 as well as through a corresponding slot in lower bin sleeve 33-1. In this manner, locking mechanism 71 serves to retain lower bin sleeve 33-1 connected to pallet anchor 31.

Bracket 73 is a frame-like, rectangular member with a flattened outer surface 77 and a flattened inner surface 79, with inner surface 79 disposed flush against the outer surface of its associated outer tab 75 when mounted onto pallet anchor 31. As can be seen, bracket 73 is shaped to define a central opening 81 which is configured and dimensioned to align with windows 67 in associated tabs 63 and 65.

A pawl, or ratchet, 83 is formed on outer surface 77 along one edge of opening 81. As can be appreciated, pawl 83 is designed to engage latch 75 when disposed in its closed position. Additionally, pawl 83 is preferably designed to articulate, or flex, slightly outward upon the application of a suitable manual force to allow for the disengagement and subsequent opening of latch 75, as needed.

Latch 75 comprises a rectangular tab, or base, 85 which includes an outer planar surface 87 and an inner planar surface 89. Tab 85 is pivotally coupled to bracket 73 by a hinge 91 formed along the periphery of central opening 81 on the opposite side from pawl 83. A tab-like handle 93 is formed on outer surface 87 and is designed to facilitate the manual displacement of latch 75 between its open and closed positions. Additionally, an enlarged bolt, or protrusion, 95 extends orthogonally out from inner surface 89 of latch 75 and is dimensioned to fittingly protrude through central opening 81 in bracket 73, windows 67 in tabs 63 and 65 as well as a corresponding slot in lower bin sleeve 33-1 when latch 75 is disposed in its closed position, as will be explained further below.

Bin Sleeve 33

Lower bin sleeve 33-1 and upper bin sleeve 33-2 are represented herein as being identical in construction. However, it is to be understood that either of lower bin sleeve 33-1 and upper bin sleeve 33-2 could be modified in design and/or dimension to suit the needs of the intended application.

Figure 9:
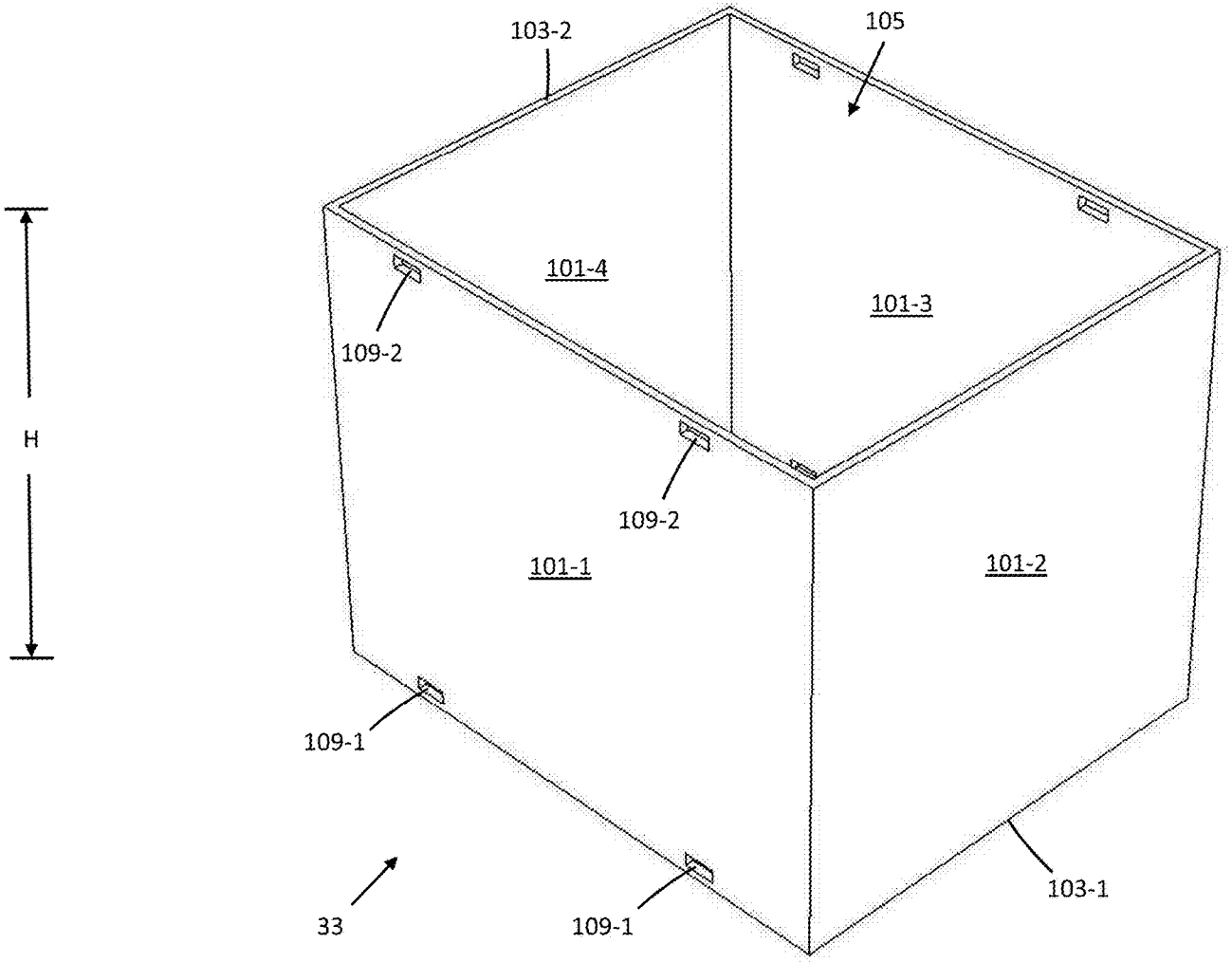
FIG. 9 is a top, front perspective view of one of the bin sleeves shown in FIG. 3.

Referring now to FIG. 9, each bin sleeve 33 is constructed as a unitary member with four adjacent panels, or sidewalls, 101-1 thru 101-4 which enable sleeve 33 to be collapsed into a flattened, generally planar configuration prior to use (i.e., for ease of storage and shipment). Preferably, sleeve 33 is constructed out of an extruded polypropylene substrate (e.g., a 10 mm extruded polypropylene bubble board, a 10 mm extruded polypropylene honeycomb panel, or a 10 mm extruded polypropylene structured core panel), corrugated paper, or any other suitable malleable material.

The four-sided construction of sleeve 33 yields an open bottom end 103-1 and an open top end 103-2 that provide access to an interior cavity 105 which is suitably dimensioned to retain the intended parcel payload.

Sleeve 33 has a height H of approximately 36 inches. Accordingly, the overall height of container 11 is approximately 72 inches when fully assembled. However, it is to be understood that container 11 could be alternatively constructed without using upper bin sleeve 33-2 or union collar 35 to create a reduced-sized storage bin with a height of approximately 36 inches. As such, the design of storage bin 11 allows for flexibility in its size to accommodate different types of payloads. Consequently, storage bin 11 can be optimized by the user to create the most spatially and economically efficient shipping container, which is highly desirable.

As can be seen, a first set of rectangular slots 109-1 is formed in panels 101-1 and 101-3 along bottom end 103-1. Similarly, a second set of rectangular slots 109-2 is formed in panels 101-1 and 101-3 along top end 103-2.

Figure 10:
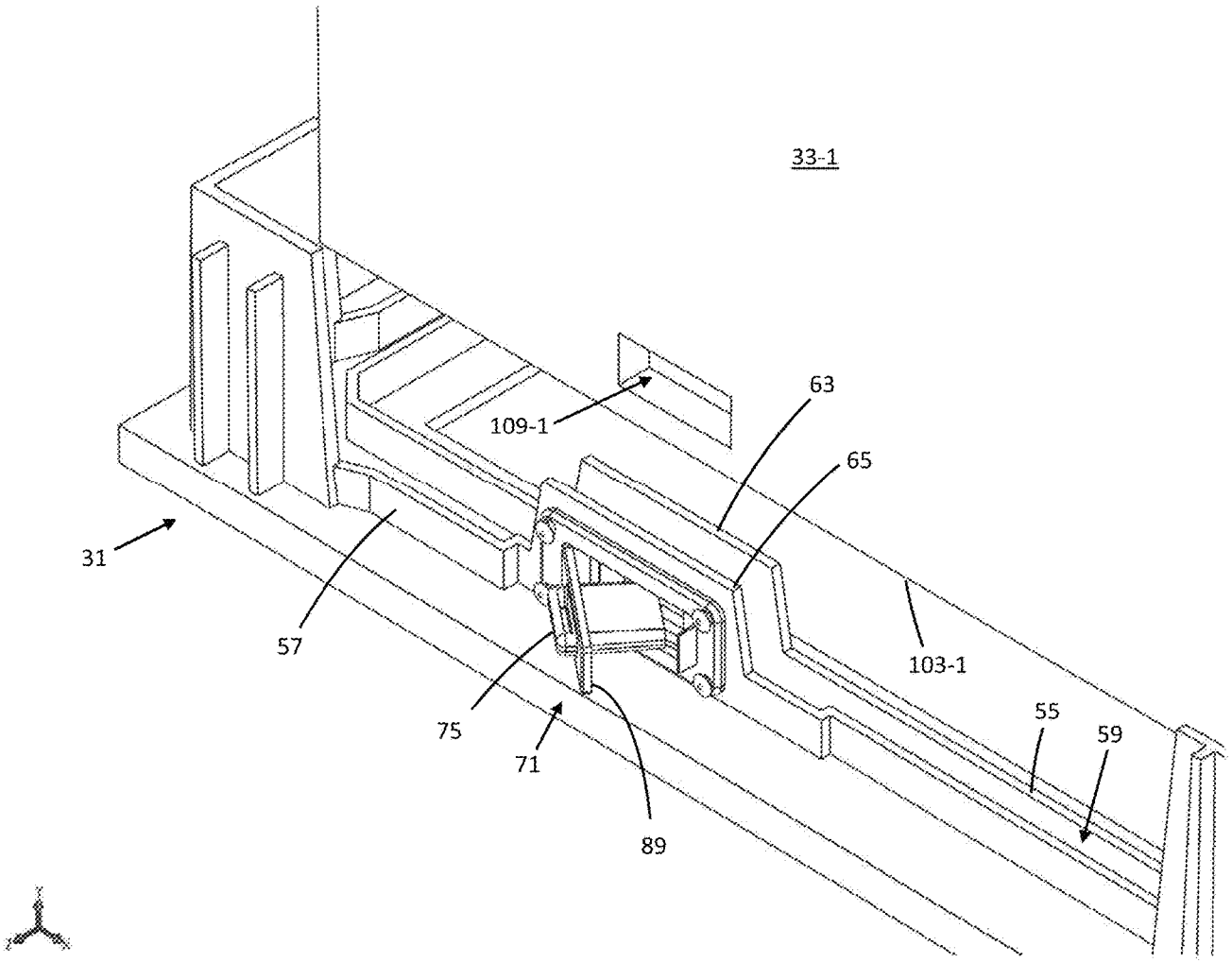
FIG. 10 is a front, top section view of the pallet anchor shown in FIG. 6, the pallet anchor being shown with the lower bin sleeve disposed in proper position for mounting thereon.
Figure 11:
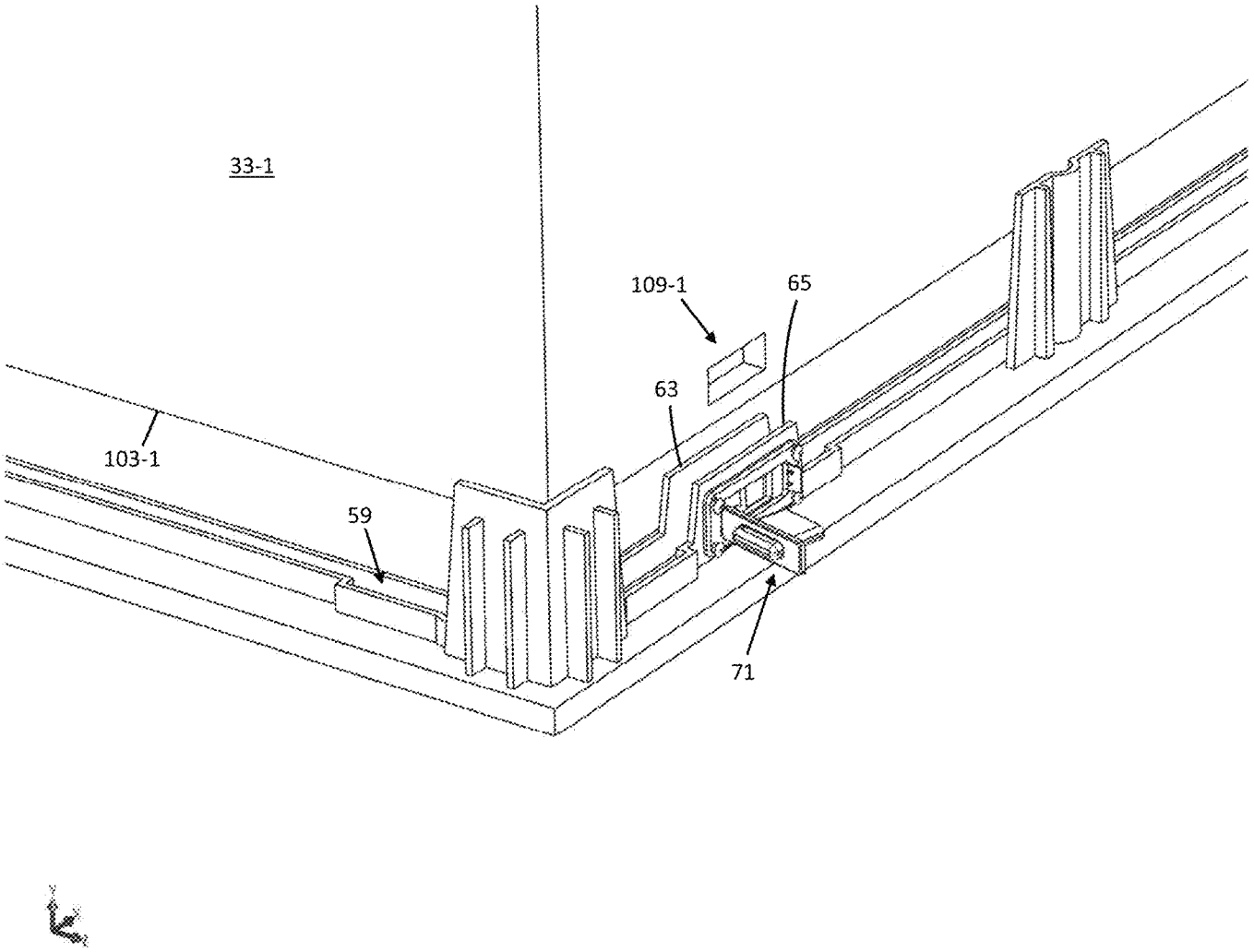
FIG. 11 is a rear, top section view of the pallet anchor shown in FIG. 6, the pallet anchor being shown with the lower bin sleeve disposed for proper position for mounting thereon.
Figure 12:
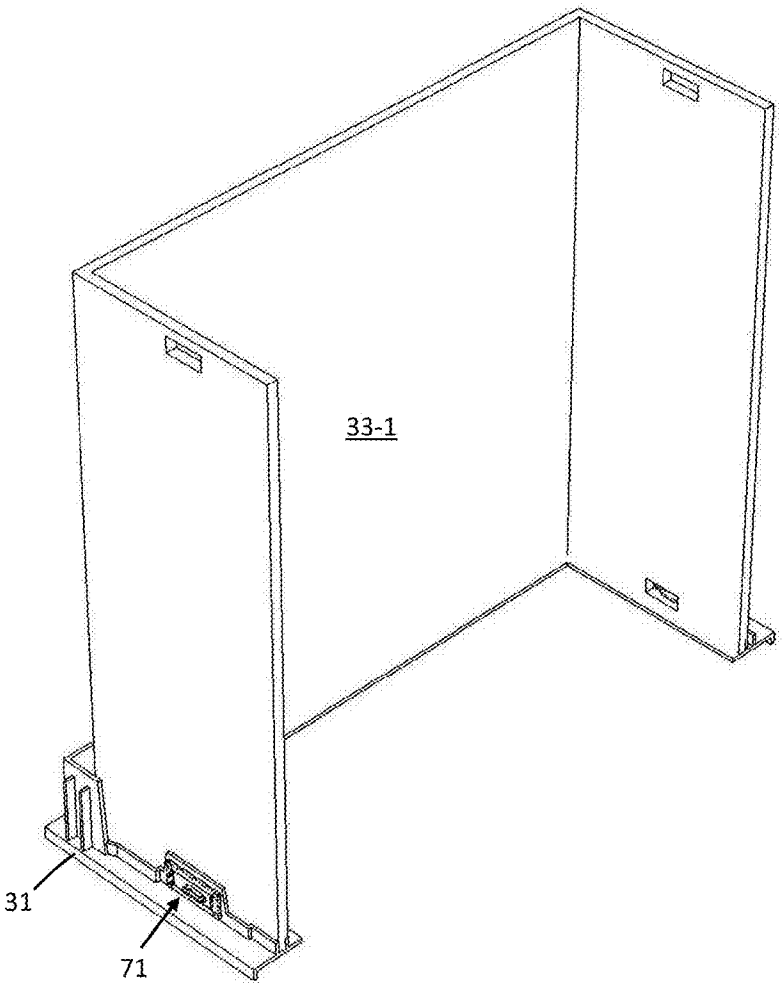
FIG. 12 is a front, top section view of the pallet anchor shown in FIG. 6, the pallet anchor being shown with the lower bin sleeve mounted thereon.

As seen most clearly in FIGS. 10-12, slots 109-1 are arranged and dimensioned to align with windows 67 in tabs 63 and 65. Therefore, by pivoting latch 75 closed, locking mechanism 71 serves to retain lower bin sleeve 33-1 connected to pallet anchor 31. As a result, storage container 11 remains securely in its assembled state during transport and is therefore less susceptible to inadvertent disassembly than conventional shipping containers.

As will be explained further below, second set of rectangular slots 109-2 is provided in lower bin sleeve 33-1 in order to secure union collar 35 to open top end 103-2. In other words, locking mechanisms 71 serve to retain the various components of storage bin 11 in a connected state, thereby creating a secure and durable shipping solution.

Although not shown herein, select panels 101 of bin sleeve 33 may include larger circular holes which may be used to, inter alia, view parcels retained within interior cavity 105 and/or grip sleeve 33 during the assembly or disassembly of container 11. Furthermore, select panels 101 of sleeve may be scored, or otherwise cut, to form an access door, which can be pivoted slightly relative to the remainder of sleeve 33 to allow for the viewing and/or placement of parcels inside container 11.

Union Collar 35

As noted briefly above, union collar 35 is designed to enable a pair of bin sleeves 33-1 and 33-2 to be stacked on top of one another in order to create a shipping container with an increased height of approximately 72 inches. At the same time, by removing union collar 35 and one bin sleeve 33, a shipping container with a limited height of approximately 36 inches can be created. In this fashion, union collar 35 provides container 11 with size flexibility, which is beneficial in accommodating different volumes of payloads.

Figure 13:
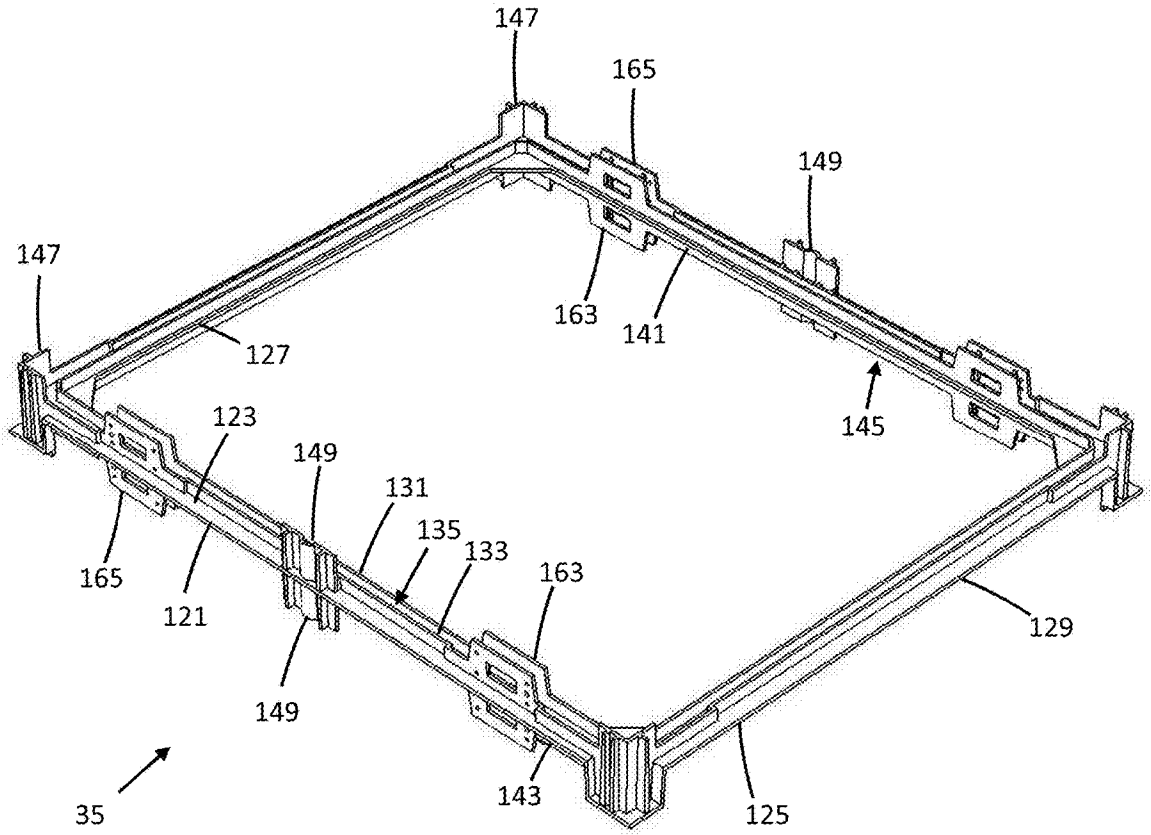
FIG. 13 is a front, top perspective view of the union collar shown in FIG. 3.

Referring now to FIG. 13, union collar 35 is similar in construction to pallet anchor 31 in that union collar 35 is preferably constructed out of a rigid and durable material, such as high-density polyethylene (HDPE). Union collar 35 is also similar to pallet anchor 31 in that union collar 35 comprises a planar frame 121 which includes a flat top surface 123, a flat bottom surface 125, an inner edge 127 and an outer edge 129.

Union collar 35 is further similar to pallet anchor 31 in that continuous inner and outer walls 131 and 133 protrude orthogonally upward from top surface 123 along inner edge 127 in a spaced apart relationship. Together, top surface 123, inner wall 131, and outer wall 133 form a U-shaped cavity 135 which is dimensioned to fittingly receive bottom edge 103-1 of upper bin sleeve 33-2 upon assembly.

Union collar 35 differs primarily from pallet anchor 31 in that union collar 35 additionally includes a second set of continuous inner and outer walls 141 and 143 that protrude orthogonally downward from bottom surface 125 along inner edge 127 in a spaced apart relationship. Together, bottom surface 125, inner wall 141, and outer wall 143 form a U-shaped cavity 145 which is dimensioned to fittingly receive top edge 103-2 of lower bin sleeve 33-1 upon assembly.

In order to provide support and reinforcement to bin sleeves 33 with container 11 in its assembled state, both outer walls 133 and 143 are lengthened at each corner to create a lengthened reinforcement region 147. Similarly, projections 149 extend from top and bottom surfaces 123 and 125 of frame 121 in a generally planar relationship with outer walls 133 and 143, respectively, at the approximate midpoint of opposing sides.

To help secure sleeves 33 to collar 35, a first set of inner tabs 163 is integrally formed onto and projects upwardly away from the distal end of both inner walls 131 and 141 at various locations along its length. Additionally, a second set of outer tabs 165 is integrally formed onto and projects upwardly away from the distal end of both outer walls 133 and 143 at various locations along its length.

As can be seen, complementary pairs of 163 and 165 are arranged in direct alignment with one another. Although not shown herein for ease of illustration, each outer tab 165 preferably supports a corresponding locking mechanism 71 which is utilized to help retain bin sleeves 33 connected to union collar 35.

Bin Cap 37

As referenced briefly above, shipping container 11 comprises a bin cap 37 which is adapted to be mounted onto the open top end 103-2 of upper bin sleeve 33-2 in order to enclose container 11. However, it should be noted that utilization of bin cap 37 is optional. Notably, in certain applications, it may be advantageous to keep bin cap 37 removed from the remainder of shipping container 11, for example, if frequent access or inspection of the shipped parcels is required.

Figure 14:
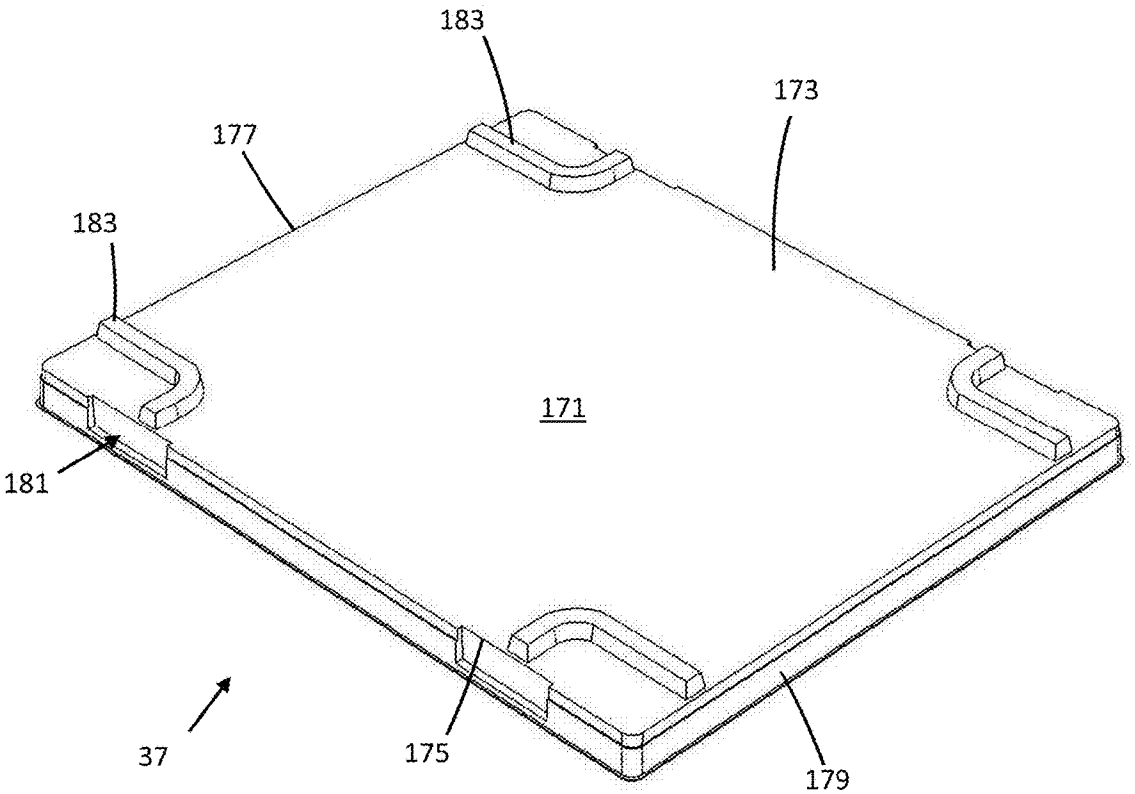
FIG. 14 is a front, top perspective view of the end cap shown in FIG. 3.
Figure 15A:
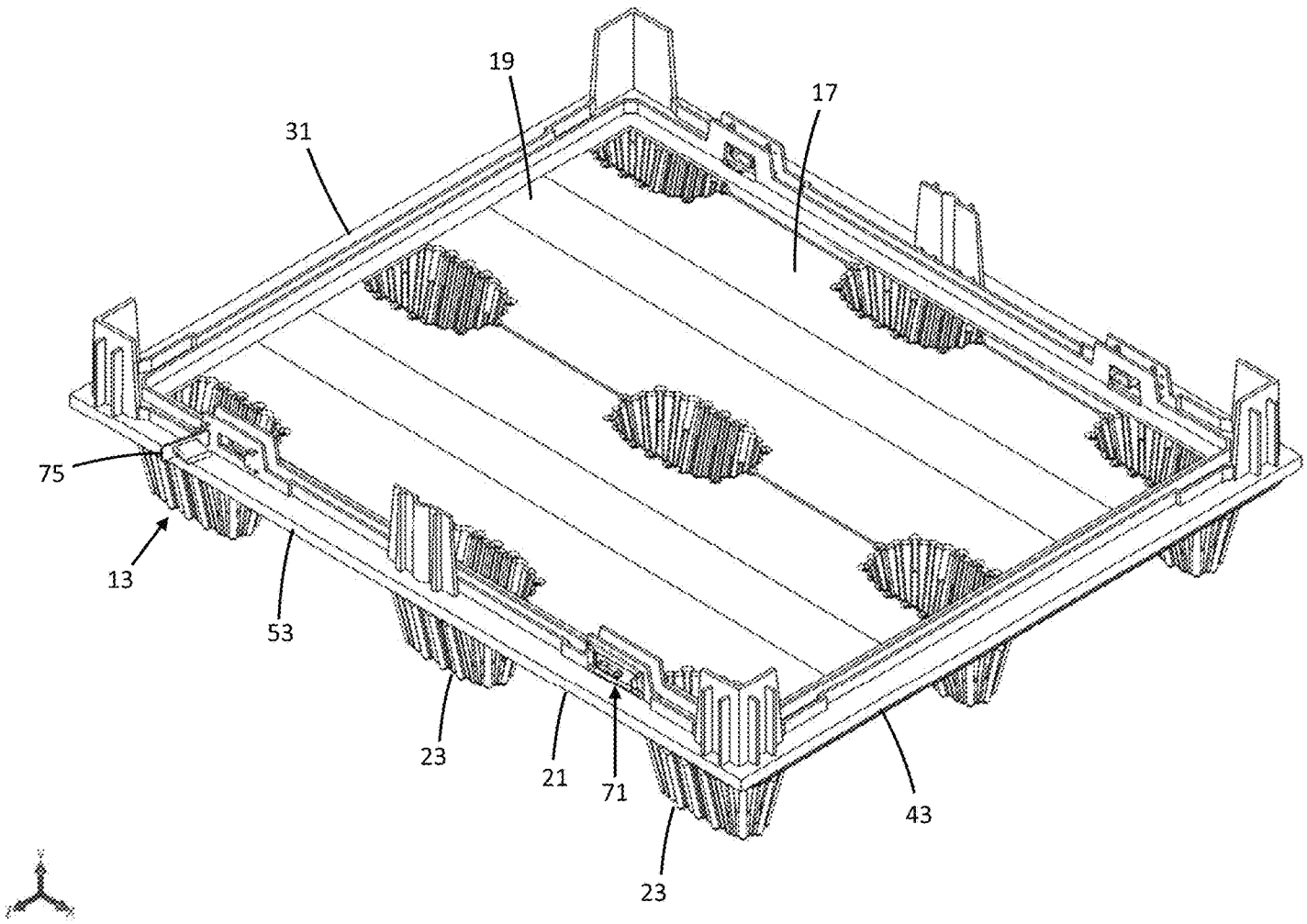
FIGS. 15(*a*)-(*f*) are front, top perspective views of the shipping container shown in FIG. 1 at various stages during its assembly and subsequent disassembly.
Figure 15B:
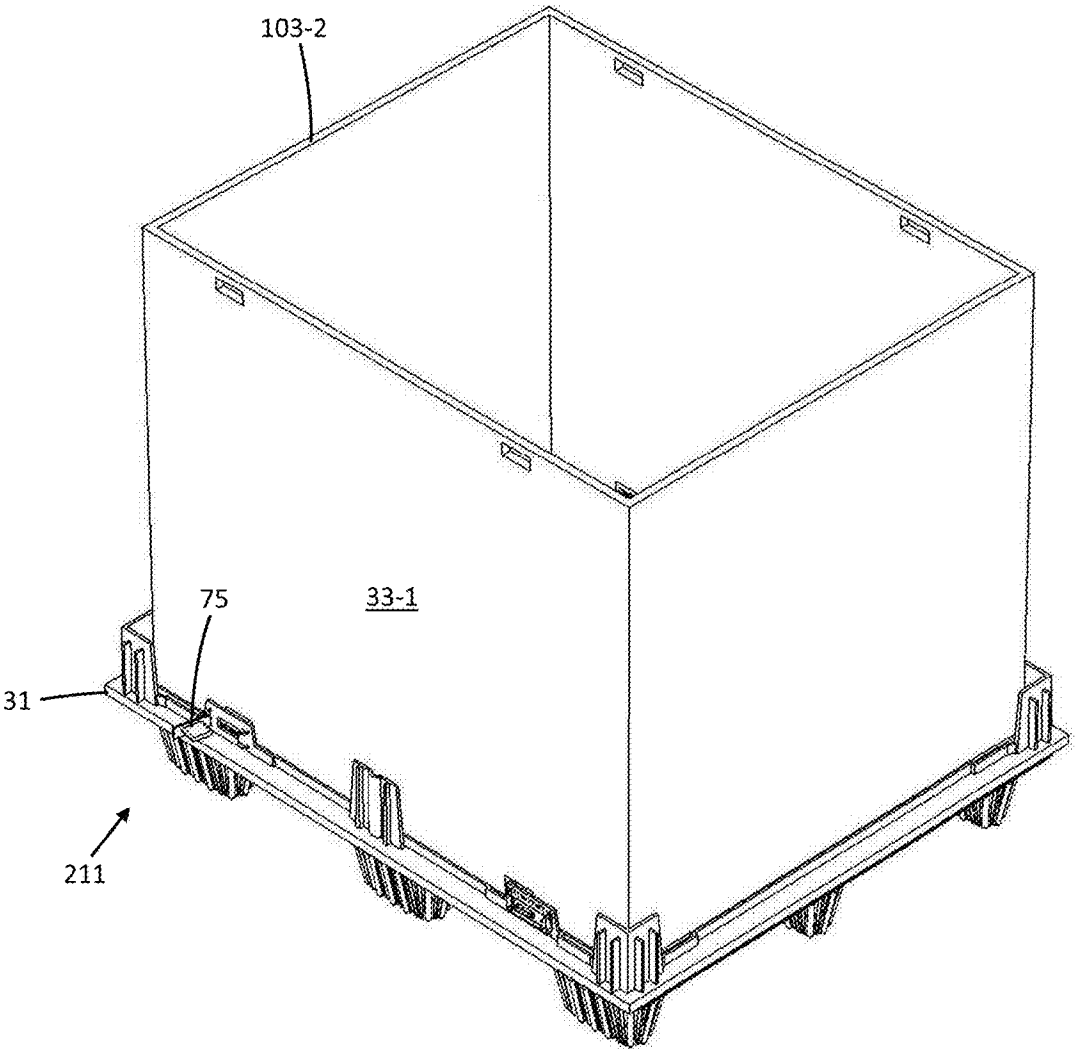
Figure 15C:
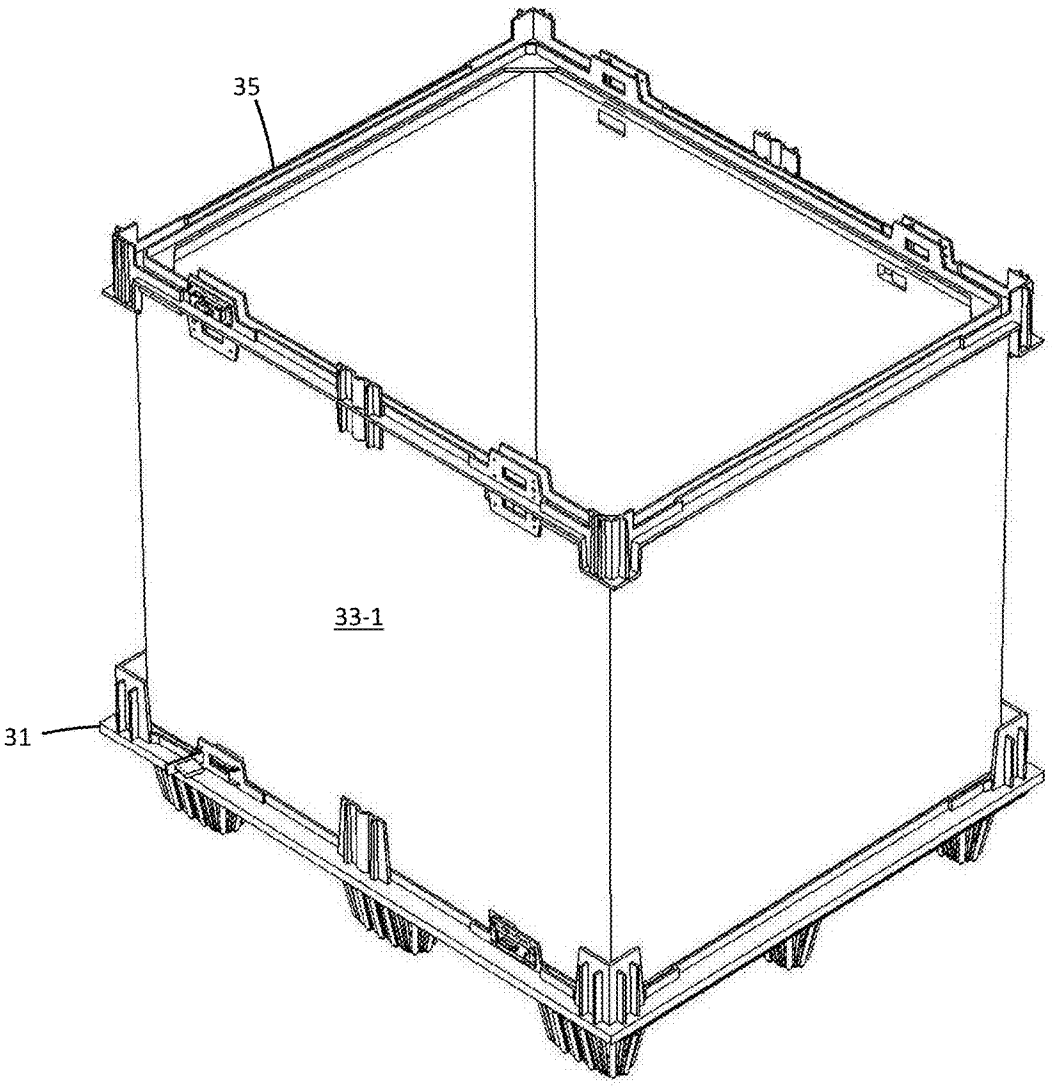
Figure 15D:
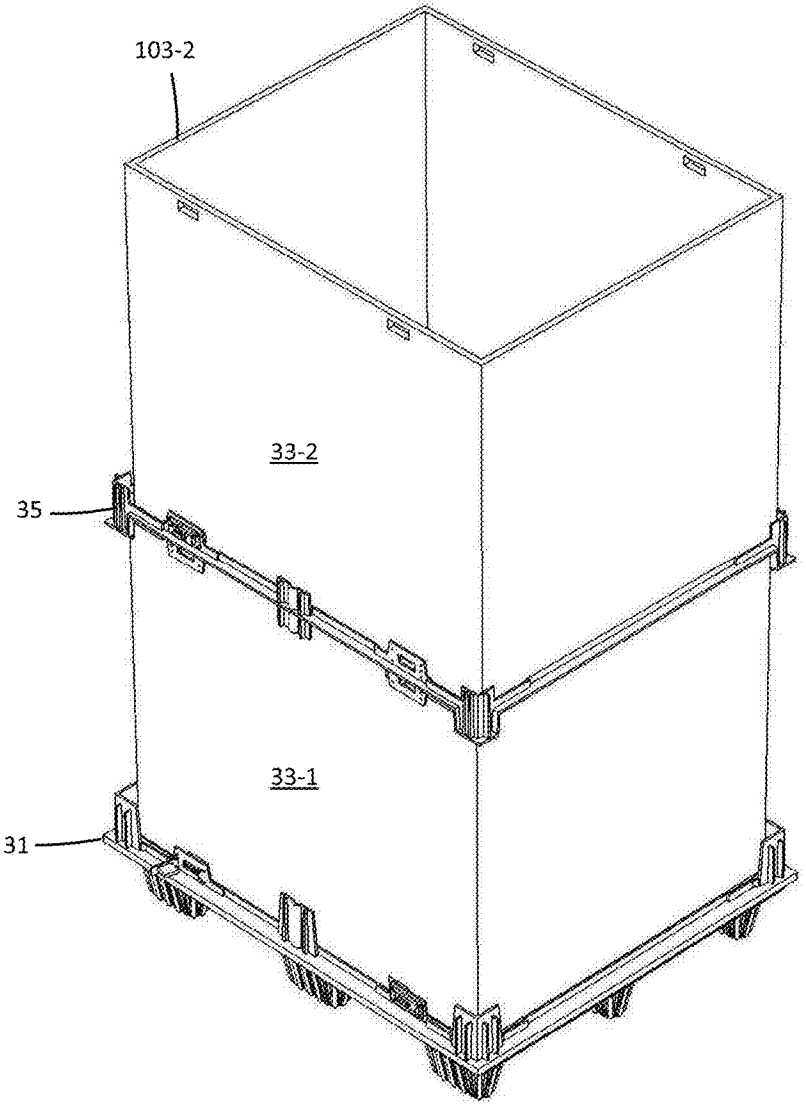
Figure 15E:
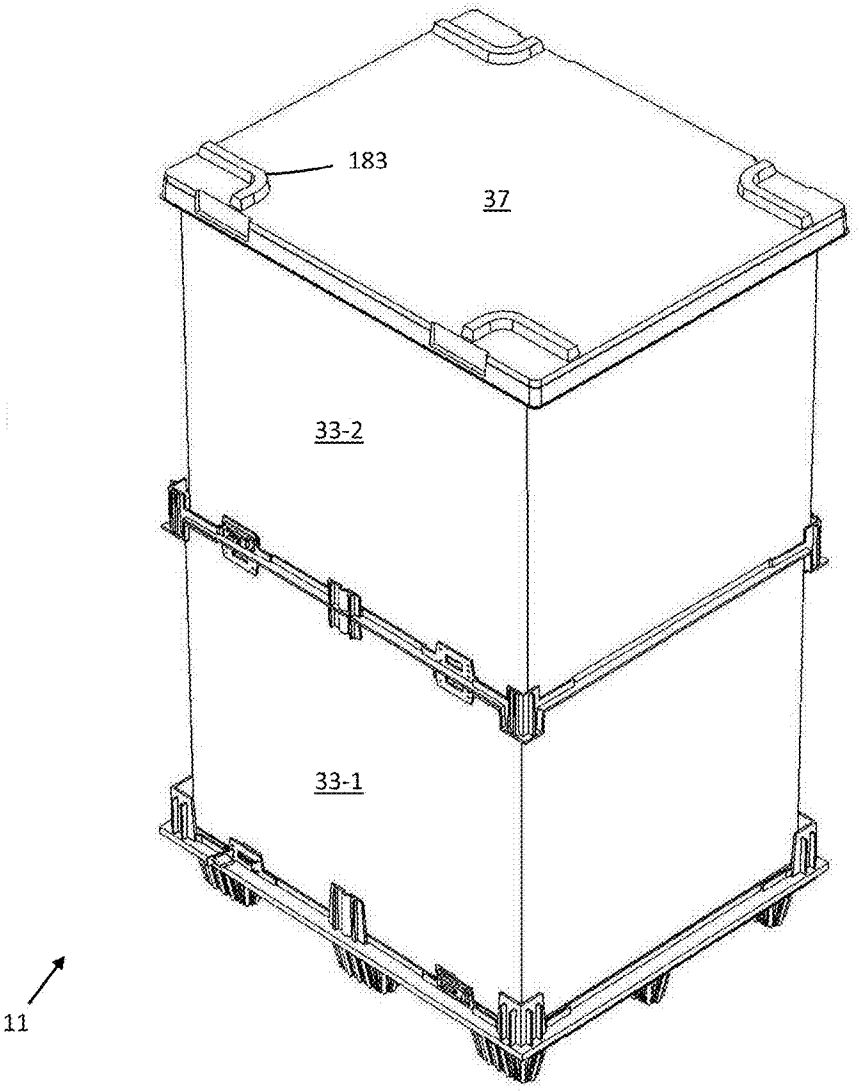
Figure 15F:
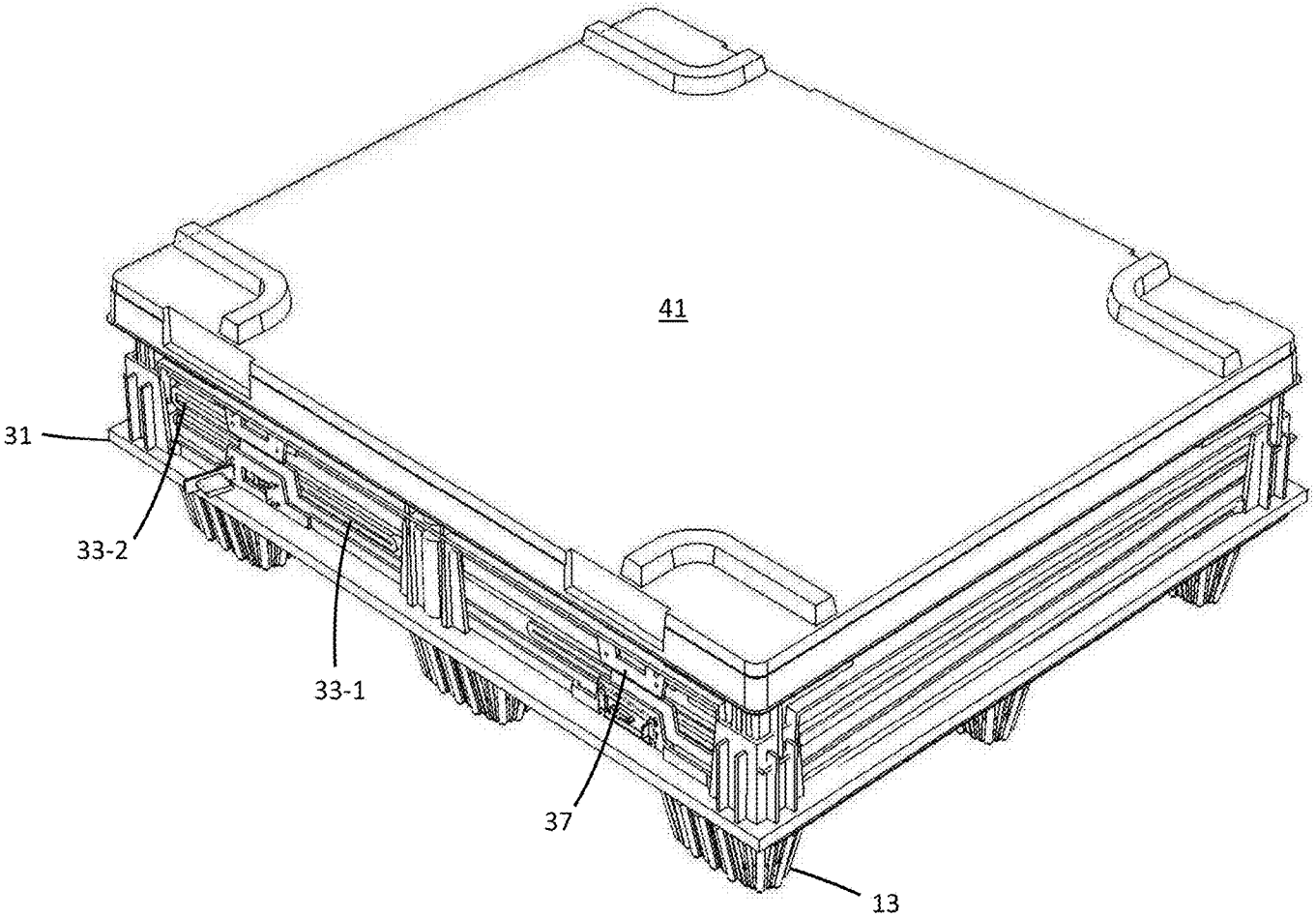

Bin cap 37 is similar to pallet anchor 31 and union collar 35 in that bin cap 37 is preferably constructed out of a rigid and durable plastic material, such as high-density polyethylene (HDPE). As seen most clearly in FIG. 14, bin cap 37 is a unitary member which includes a rectangular plate 171 which includes a flat outer, or top, surface 173, a flat bottom surface 175, and a peripheral edge 177. A continuous sidewall 179 protrudes orthogonally downward from bottom surface 175 along peripheral edge 177.

Accordingly, bin cap 37 is configured and dimensioned to cover upper bin sleeve 33-2 with sidewall 179 disposed in abutment against panels 101 to help retain bin cap 37 in place on upper bin sleeve 33-2.

A plurality of rectangular cutouts 181 are formed in sidewall 179. Cutouts 181 are positioned so as to directly align with slots 109-2 in bin sleeve 33 along top end 103-2. Accordingly, by mounting a locking mechanism 71 onto bin cap 37 over each cutout 181, the user is provided with the ability to selectively lock bin cap 37 in place on upper bin sleeve 33-2.

A plurality of J-shaped ribs, or projections, 183 is formed on top surface 173 of plate 171, with one rib 183 located in each corner of plate 171. It is to be understood that ribs 183 facilitate the stacking of a pallet 13 onto top surface 173 of bin cap 37. Notably, with a pallet 13 mounted onto bin cap 37, one foot 23 is positioned in each corner of plate 171 and is retained in place by a corresponding rib 183. In this manner, ribs 183 enable multiple shipping containers 11 to be stacked one on top of another with limited risk of inadvertent sliding or vertical misalignment during transport.

Assembly of Shipping Container 11

Referring now to FIGS. 15(*a*)-(*f*), shipping container 11 is designed to be constructed through a simple and efficient assembly process. As referenced above, the ability to releasably secure together adjacent components provides container 11 with a more sturdy and reliable assembly than conventional shipping containers, which is a principal object of the present invention.

To assemble container 11, feet 23 of flat deck pallet 13 are preferably disposed on a suitable mounting surface. Thereafter, as shown in FIG. 9(*a*), pallet anchor 31 is disposed onto top surface 19 of pallet 13. Disposed as such, flange 53 abuts against the outer edge of pallet tray 17 and thereby maintains proper registration of anchor 31 onto pallet 13.

As previously referenced, pallet anchor 31 may be equipped with an optional latch mechanism (not shown) that is adapted to slide horizontally relative to frame 43 and align directly against bottom surface 21 of pallet 13. As a result, pallet anchor 31 is secured onto top surface 19 and cannot be lifted off pallet 13 until the latch mechanism is released. As an alternative to such a latch mechanism, a fastener (not shown) may be permanently driven vertically downward through frame 43 and into pallet 13 in order to secure pallet anchor 31 in place. However, permanently joining frame 43 onto pallet 132 in this fashion would preclude any subsequent separation of the components for individual future reuse.

With pallet anchor 31 mounted in place on pallet 13, latch 75 for each locking mechanism 71 is pivoted into its open, or unlocked, position. Thereafter, lower bin sleeve 33-1 is mounted onto pallet anchor 31. More specifically, bottom end 103-1 of lower bin sleeve 33-1 is disposed in vertical alignment within U-shaped cavity 59, as seen in FIGS. 10 and 11. Bin sleeve 33-1 is then urged downward until bottom end 103-1 contacts the portion of top surface 45 between inner wall 45 and outer wall 55, as shown in FIG. 15(*b*). Preferably, bin sleeve 33-1 is of a thickness so as to create a friction fit within cavity 59, thereby creating a significant retentive force.

Positioned, as such, each latch 75 is pivoted into its closed position. As noted above, each latch 75 penetrates through windows 67 in corresponding tabs 63 and 65 as well as through its associated slot 109-1 and thereby secures lower bin sleeve 33-1 in a connected state with pallet anchor 31 and thereby indirectly to pallet 13. As can be appreciated, the combination of the frictional engagement of lower bin sleeve 33-1 within cavity 59 as well as the penetration of each latch 75 through windows 67 and slots 109 renders the assembly of container 11 considerably less prone to disassembly than conventional containers, which is a primary object of the present invention.

In certain applications, a container of limited height (i.e., approximately 36 inches) is desired. For these applications, the assembly process terminates, resulting in the limited height container shown in FIG. 15(*b*), which is identified generally by reference numeral 211. If closure of container 211 is desired, bin cap 37 is mounted onto open top end 103-2 of lower bin sleeve 33-1. In turn, optional locking mechanisms 71 on bin cap 37 can be used to retain bin cap 37 in place on bin sleeve 33-1.

For larger payloads, container 11 is typically preferred. As noted above, container 11 is approximately 72 inches in height and thereby provides double the capacity of reduced-size container 211. To construct container 11 with lower bin sleeve 33-1 secured in place on pallet anchor 31, union collar 35 is positioned directly above open top end 103-2 of lower bin sleeve 33-1.

With each latch 75 on union collar 35 disposed in its open position, union collar 35 is urged downward onto lower bin sleeve 33-1 with open top end 103-2 penetrating into cavity 145 formed between inner and outer walls 141 and 143, as shown in FIG. 15(*c*). Thereafter, upper bin sleeve 33-2 is disposed in alignment above union collar 35 and subsequently urged vertically downward such that open bottom end 103-1 of upper bin sleeve 33-2 penetrates into cavity 135 formed between inner and outer walls 131 and 133, as shown in FIG. 15(*d*).

Each latch 75 on union collar 35 is then preferably pivoted into its closed position. As such, locking mechanisms 71 serve to fixedly connect both bin sleeves 33 onto union collar 35 in a stacked configuration. Constructed as such, the intended payload can be deposited through open top end 103-2 of upper bin sleeve 33-2. If an enclosed container is desired, bin cap 37 is preferably mounted onto open top end 103-2 of upper bin sleeve 33-2, as shown in FIG. 15(*e*). In turn, optional locking mechanisms 71 on bin cap 37 can be used to retain bin cap 37 in place on bin sleeve 33-2.

In this manner, enclosed container 11 is suitably designed for the storage and/or transport of parcels. Due to the inclusion of ribs 183, a secondary pallet 13 can be secured in place on bin cap 37, and thereby allow for additional stacking, if needed.

Once access to the contents within container 11 is required, all latches 75 are pivoted open, thereby allowing for the separation of components. Due to the rigid and durable construction of its individual components, container 11 is well suited for reuse, which is a principal object of the present invention.

When not in use, container 11 can be maintained as a highly compact stack. Specifically, as shown in FIG. 15(*f*), each of bin sleeves 33-1 and 33-2 is preferably collapsed into a generally flattened condition. With pallet anchor 31 mounted onto pallet 13, bin sleeves 33-1 and 33-2 are, in turn, mounted onto pallet 13. Lastly, union collar 37 and end cap 39 are mounted onto the stack so as to yield a highly compact arrangement of components. Configured as such, container 11 is well suited for storage and/or delivery until future use is required.

FEATURES AND ADVANTAGES OF THE PRESENT INVENTION

The particular construction of shipping container 11 provides a number of notable advantages over conventional shipping containers.

As a first advantage, shipping container 11 is designed with a relatively strong degree of interconnection between the various components. Specifically, the use of frictional engagement and latch-type locking mechanisms 71 between adjacent components helps retain container 11 in its assembled state and thereby prevent inadvertent disconnection, which is a common problem associated with conventional shipping containers.

As a second advantage, shipping container 11 is preferably constructed using rigid and durable plastic materials which are able to withstand pressure from parcels retained therein without significant bulging or distending. As a result, parcels retained in container 11 remain secure and protected at all times during transport.

As a third advantage, shipping container 11 is designed as a reusable shipping solution. Notably, the durable materials utilized for the individual components as well as the releasable connection between adjacent parts renders container 11 well suited for repeat usage. As a result, container 11 provides a low-cost and environmentally-friendly means for storing and shipping parcels.

As a fourth advantage, shipping container 11 is designed to be reconfigurable in size based on the intended use. In particular, container 11 is designed to be constructed as either a single-sleeve bin of approximately 36 inches in overall height or a double-sleeve, or stacked, bin of approximately 72 inches in overall height. Consequently, container 11 can be modified in size to accommodate different sized payloads in an optimized fashion.

The invention described in detail above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A storage bin for a flat deck pallet, the flat deck pallet having a top surface, a bottom surface, and an outer peripheral edge, the storage bin comprising:

(a) an anchor deck adapted to be mounted onto the top surface of the flat deck pallet about the outer peripheral edge, the anchor deck comprising, (i) a generally rectangular frame which includes a flat top surface, a flat bottom surface, an inner edge, an outer edge, and a continuous flange that protrudes downward from the bottom surface along the outer edge, (ii) a continuous inner wall that protrudes orthogonally upward from the top surface, and (iii) a continuous outer wall that protrudes orthogonally upward from the top surface at a fixed distance spaced apart from the continuous inner wall, (iv) wherein the top surface, the continuous inner wall, and the continuous outer wall together define a U-shaped cavity, (v) wherein, with the anchor deck mounted onto the pallet, the continuous flange of the anchor deck is dimensioned to abut against the outer peripheral edge of the pallet to ensure proper registration is maintained; and (b) a lower bin sleeve mounted onto the anchor deck, the lower bin sleeve having an open top end and an open bottom end, wherein the U-shaped cavity in the anchor deck is dimensioned to fittingly receive the bottom end of the lower bin sleeve;

(c) wherein the anchor deck comprises at least one locking mechanism for releasably securing the lower bin sleeve to the anchor deck, the at least one locking mechanism comprising a buckle onto which a latch is pivotally coupled, the latch being configured to pivot between an open position and a closed position.

2. The storage bin as claimed in claim 1 wherein a portion of the latch is dimensioned to fittingly protrude through a slot formed in the lower bin sleeve in alignment therewith when the latch is disposed in its closed position.

3. The storage bin as claimed in claim 2 wherein an articulating pawl is formed on the buckle to releasably retain latch in its closed position.

4. The storage bin as claimed in claim 1 further comprising a union collar mounted onto the open top end of the lower bin sleeve.

5. The storage bin as claimed in claim 4 further comprising an upper bin sleeve mounted onto the union collar, the upper bin sleeve having an open top end and an open bottom end.

6. The storage bin as claimed in claim 5 wherein each of the lower and upper bin sleeves includes four adjacent sidewalls.

7. The storage bin as claimed in claim 6 wherein the union collar maintains the sidewalls of the upper bin sleeve in direct coplanar alignment with the sidewalls of the lower bin sleeve.

8. The storage bin as claimed in claim 5 wherein each of the lower and upper bin sleeves is constructed of a plastic material.

9. The storage bin as claimed in claim 8 wherein each of the lower and upper bin sleeves is constructed out of at least one material from the group consisting of polypropylene bubble board, polypropylene honeycomb panel, and polypropylene structured core panel.

10. The storage bin as claimed in claim 5 wherein the union collar comprises:

(a) a planar frame having a flat top surface, a flat bottom surface, an inner edge, and an outer edge;

(b) a first pair of walls protruding orthogonally downward from the bottom surface of the planar frame at a fixed distance apart from one another so as to define a first U-shaped cavity dimensioned to fittingly receive the top edge of the lower bin sleeve; and (c) a second pair of walls protruding orthogonally upward from the top surface of the planar frame at a fixed distance apart from one another so as to define a second U-shaped cavity dimensioned to fittingly receive the bottom edge of the top bin sleeve.

11. The storage bin as claimed in claim 10 wherein the union collar comprises a first set of locking mechanisms for releasably securing the lower bin sleeve to the union collar and a second set of locking mechanisms for releasably securing the upper bin sleeve to the union collar.

12. The storage bin as claimed in claim 5 further comprising an end cap adapted to be mounted onto the open top end of one of the lower bin sleeve and the upper bin sleeve.

* * * * *